US006267265B1

(12) United States Patent
Issa

(10) Patent No.: US 6,267,265 B1
(45) Date of Patent: Jul. 31, 2001

(54) PILL DISPENSER

(76) Inventor: Hassan Issa, 59 Spruce Meadows Dr., Kanata, Ontario (CA), K2M 2K4

( * ) Notice: Subject to any disclaimer, the term of this patent is extended or adjusted under 35 U.S.C. 154(b) by 0 days.

(21) Appl. No.: 09/546,381

(22) Filed: Apr. 10, 2000

Related U.S. Application Data

(63) Continuation-in-part of application No. 09/030,864, filed on Feb. 26, 1998, now Pat. No. 6,119,894.

(51) Int. Cl.[7] ..... G07F 11/06

(52) U.S. Cl. ..... 221/288; 221/90; 221/263; 222/534; 222/536

(58) Field of Search ..... 221/288, 263, 221/264, 265, 266; 222/534, 535, 536

(56) References Cited

U.S. PATENT DOCUMENTS

| | | | | |
|---|---|---|---|---|
| 2,838,204 | | 6/1958 | Snyder | 221/307 |
| 3,189,222 | * | 6/1965 | Smalley | 221/288 X |
| 3,257,029 | | 6/1966 | Smalley | 221/301 |
| 3,480,182 | * | 11/1969 | Rigor | 221/288 |
| 3,604,593 | * | 9/1971 | Curci | 221/288 |
| 3,610,468 | * | 10/1971 | Borsum | 221/288 X |
| 3,622,041 | * | 11/1971 | Borsum et al. | 221/288 X |
| 3,637,109 | * | 1/1972 | Stifter | 221/288 X |
| 3,991,908 | | 11/1976 | Thomas et al. | 221/154 |
| 4,522,313 | * | 6/1985 | Jennings et al. | 221/288 X |
| 4,530,447 | * | 7/1985 | Greenspan | 221/288 |
| 4,648,529 | * | 3/1987 | Blakemore et al. | 221/288 X |
| 4,653,668 | | 3/1987 | Gibilisco et al. | 221/298 |
| 4,723,690 | | 2/1988 | Vom Hofe | 221/96 |
| 4,887,738 | | 12/1989 | Jennings et al. | 221/264 |
| 5,484,089 | * | 1/1996 | Picerno | 222/534 |
| 5,524,799 | | 6/1996 | Skillin | 222/534 |
| 5,791,515 | | 8/1998 | Khan et al. | 221/154 |
| 5,897,025 | | 4/1999 | Flewitt et al. | 221/257 |

FOREIGN PATENT DOCUMENTS

| | | | |
|---|---|---|---|
| 002677615 | * | 12/1992 | (FR) . |
| 0863472 | * | 9/1981 | (SU) . |

* cited by examiner

*Primary Examiner*—Christopher P. Ellis
*Assistant Examiner*—Patrick Mackey
(74) *Attorney, Agent, or Firm*—Freedman & Associates

(57) ABSTRACT

A pill dispenser to dispense a pill received from a pill container engaged therebelow. The pill dispenser comprises a cavity, said cavity having an exposed end and shaped to form a conical surface therein. The conical shape of the dispenser cavity, advantageously, allows pills to be engaged therein and dispensed therefrom, one at time, regardless of the shape and size of the pills. Optionally, the pill dispenser is disposed within a cap or closure member, mountable to common containers available at most retail outlets. Further optionally, the pill dispenser is disposed within the container itself.

35 Claims, 16 Drawing Sheets

PILL DISPENSER

The present application is a Continuation in Part of U.S. patent application Ser. No. 09/030,864 filed Feb. 26, 1998, now U.S. Pat. No. 6,119,894.

BACKGROUND OF THE INVENTION

1. Field of the Invention

The present invention relates to a dispenser, for use with a supply of pills, tablets, pellets, capsules, or the like. In particular, the invention relates to a dispenser, wherein the supply of pills, tablets, pellets, or capsules is dispensable therefrom one at a time.

2. Description of the Prior Art

All consumers are well aware of the difficulties involved in removing pills, tablets, pellets, capsules, or the like from a container. In most containers, the neck is too small to effectively reach in and remove a pill. To compensate, the user generally attempts to remove a pill by tipping the container in a manner that causes a portion of contents therein to go into the user's hand. This frequency results in a greater number of pills being dispensed than is desired, and consequently, the sterility of the pills is destroyed when the excess pills are returned to the container. Furthermore, this procedure is awkward and time consuming, particularly when a pill is needed immediately for medical reasons. In the prior art, there have been numerous attempts to provide a dispenser for dispensing one pill at a time.

For example, U.S. Pat. No. 2,838,204 to Snyder teaches a pill dispenser having a single piece design. The dispensing portion is a flat-walled tube of resilient material having a longitudinal slit through which individual pills are manually manipulated therethrough. The pill dispenser provides protection from moisture or other forms of contamination.

U.S. Pat. No. 3,257,029 to Snyder teaches a pill dispenser having a two piece design adapted to engage the neck of a pill container. The user is required to rotate one piece of the design with respect to another to effect dispensing of a pill by a series of successive rotative movements while the container is held upside down.

U.S. Pat. No. 3,991,908 to Thomas et al. teaches a pill dispensing cap assembly adapted for mounting on the neck of a pill container. The cap assembly includes a plurality of different components, including a rotor member to pick up a pill from the container and transfer it to a dispensing end. The design of the cap was directed towards nitroglycerin tablets and others of similar shape and size, ad would have to be adapted for use with pills of different shapes and/or sizes.

In U.S. Pat. No. 4,653,668 there is disclosed a container for storing and disposing small objects, such as capsules or pills containing medicament, one at a time. The container comprises a receptacle containing, within itself, a delivery mechanism including a funnel-shaped exit port for capsules and a capsule or pill delivery tube at the end of said funnel-shaped exit designed to accomodate no more than one pill or capsule. The inner end of the receptacle is pressed into or twisted in the user's hand which moves resiliently mounted gate members, thus opening the delivery tube and delivering a single small object to the user.

U.S. Pat. No. 4,887,738 discloses an article dispenser especially useful for dispensing pills of the prescription drug or over-the-counter type, comprising three components including a container member, a dispenser control member and a flexible member. The container member provides a dispenser portion through which the articles are passed in a serial array whereby one article reaches an exit aperture while the remaining articles are restrained at gate apertures within the dispenser portion by the flexible member and the control member. The dispenser components are preferably made of low-cost molded plastic and when assembled provide an easy access dispenser not requiring two hands for activation.

U.S. Pat. No. 5,791,515 there is disclosed a one-at-a-time pill container and dispenser having a mechanism which allows for use of the device with existing containers. A child-proof lock is provided. The device has a mechanism for ensuring that only a single pill is brought into the dispensing chamber as a consequence of a partial rotation of the cap with respect to the bottle body. A reverse partial rotation of the cap then allows the pill to fall by gravity into the user's hand.

While the prior art teaches effective means for dispensing pills one at a time, there are a number of inherent drawbacks in the disclosed designs.

One disadvantage inherent in the prior art, is fact that the range of pill shapes and sizes is restricted for any one dispenser. Consequently, the pill dispensers are constructed with specifications dictated by the predetermined size and shape of the pill. Obviously, having to manufacture a unique dispenser of each pill with a different size and shape escalates the manufacturing costs, and limits the interest in one-at-a-time pill dispensers. Thus, there is a need for a one-at-a-time pill dispenser that can accomodate and operate with a variety of pill shapes and sizes.

Another drawback is that most of these designs are too intricate to economically mass-produce for use with currently available commercial products e.g., bottles containing prescription drugs or over-the counter medications. In fact, there is an unmet demand for a low cost, easy to manufacture one-at-a-time pill dispenser, which requires little or no assembly. Thus, it is highly desirable to device a pill dispenser with a limited number of components to reduce manufacturing and assembly costs.

Another disadvantage found in some pill dispensers relates to the manual dexterity needed to operate the one-at-a-time pill mechanism. Much of the prior art teaches rotative manipulation of the pill dispenser, while other prior art requires a considerable amount of manual manipulation. Many users, some of which have acute restrictions, require a pill dispenser that does not involve rotative motions, and that also requires limited manual manipulation. Furthermore, many users have great difficulty in determining how one-at-a-time pill dispensers operate, thus limiting the extent to which prior art devices can be used. Accordingly, it is desirable to produce an easy to use pill dispenser, which dispenses one pill at a time with limited manual manipulation and/or rotation of the user's hands.

Yet another disadvantage in the prior art is the absence of an inherently childproof mechanism. Typically, the child-proof mechanisms that are used make it difficult for persons using the pill dispenser to acquire a pill(s) in an easy and rapid manner. In particular, many of these mechanisms are burdensome on arthritic patients.

Furthermore, in some instances the pill container of the prior art requires modifications to mount the dispensing assembly. It is desired that the pill dispensing assembly be readily mountable on typical off-the-shelf pill containers and/or those provided at most pharmacies.

Also described in the prior art, are one-at-a-time pill dispensers that only dispense one pill at a time. In many circumstances, it is desirable to dispense more than one pill at a time, even though normally only one pill is dispensed at a time. For example, consider a typical container of pain reliever for use in an environment with several individuals. Although most individuals will only need to dispense one pill at a time, there are some individuals who require more than one pill at a time, and enjoy the speed and convenience of removing more than one pill at a time. These individuals become frustrated if the option of removing more than one pill at a time is eliminated. In the prior art, there are also described one-at-a-time dispensers that are integrated within the design of the container. In such circumstances, individuals who do not wish to use the one-at-a-time mode of delivery are required to do so. Furthermore, if the mechanisms for dispensing one pill at a time is damaged, the container is rendered useless. It is desirable to have a one-at-a-time pill dispenser that operates in two modes of operation, namely a uni-mode and a multi-mode, and that is readily adaptable to commercial containers.

In general, it is highly desirable to invent a pill dispenser that is less expensive to manufacture and/or assemble, is easy to use, and which involves a different type of motion by the user to gain access to the articles contained therein.

SUMMARY OF THE INVENTION

In order to overcome some of the drawbacks of the prior art, it is an object of the invention to provide a one-at-a-time pill dispenser with a simple manufacturing design.

Another object of the invention is to provide a means to dispense one pill at a time without difficult hand manoeuvres of the user.

Another object of the invention is to provide a pill dispensing cap that is readily mountable on typical pill containers available at most pharmacies.

Accordingly, there is provided a one-at-a-time pill dispenser, comprising: a receptacle having an open end for receiving pills therethrough, a closed end from which the pills are prevented from exiting, and a cavity defined by an internal surface of the receptacle extending from the open end and converging at an apex in the closed end, said cavity designed with a depth sufficient for accomodating one or more of the pills therein, and a shape characterised in that at least part of the internal surface defines a region near the closed end where single pill becomes engaged when the dispenser is tipped with the closed end pointed downwards in a receiving mode of operation, and retained therein when the dispenser is tipped with the closed end pointed upwards in a resting mode of operation.

According to another embodiment of the invention, there is provided a one-at-a-time pill dispenser for dispensing individual pills from a container containing a number of randomly arranged pills, said pill dispenser comprising: a receptacle having a cavity with an approximately conical form for accommodating the pills therein, the receptacles having an open end corresponding to a base of the conical form for receiving the pills therethrough and having a closed end corresponding to an apex of the conical form for engaging and trapping a single pill therein; and a cover for supporting the receptacle and for engaging a neck region of the container containing the randomly arranged pills.

According to another embodiment of the invention there is provided a pill dispensing cap assembly to dispense a pill or the like received from a pill container engaged therebelow, the assembly comprising two components, namely a dispenser to dispense one pill, and a base. A cavity in the dispenser is provided, the cavity having an exposed end and being shaped to form a conical surface therein. The conical shape of the dispenser cavity, advantageously, provides for the engagement and dispensing of one pill from the pill container regardless of the shape and size of the pills. The base is adapted to pivotably receive the dispenser, the base having an opening for pill communication between the pill container and the cavity, and a bottom portion for the base adapted to engage the pill container in a child proof manner. In addition, there are two opposed pins extending outwardly on lateral surfaces of the dispenser to engage the base. A cam on a bottom portion of the dispenser engages the opening. Pivoting spring means engage the pins and cooperate with the cam and the pins to provide a switchable pill dispensing and pill receiving position for the dispenser.

The present invention has particularly advantageous applications in the pharmaceutical industry for containing and dispensing pills such as vitamins, prescription drugs, or other products that are conveniently packaged in pill form. One of the principle advantages of the present invention resides in the convenience of dispensing pills one at a time from a container, thus retaining the purity of the contents therein, and the ease with which pills are dispensed, thus allowing for fast, efficient use of the dispenser. The ease of dispensing pills by means of the present invention, which is readily accomplished by the use of one hand in many of the embodiments, is particularly beneficial to individuals who otherwise would encounter great difficulty in obtaining a pill.

Other advantages of the present invention relate to the simple design and low manufacturing costs. More specifically, this simple design can be manufactured and sold for use with a plurality of pills, pill containers, and/or applications. The fact that the pill dispenser of the instant invention works for pill of all sizes and shapes is particularly advantageous. Many embodiments of the present invention incorporate an inherently childproof mechanism.

BRIEF DESCRIPTION OF THE DRAWINGS

In order that the invention may be more clearly understood, preferred embodiments thereof will now be described in detail, by way of example, with reference to the accompanying drawings, in which.

DETAILED DESCRIPTION OF THE INVENTION

Figure 1A:
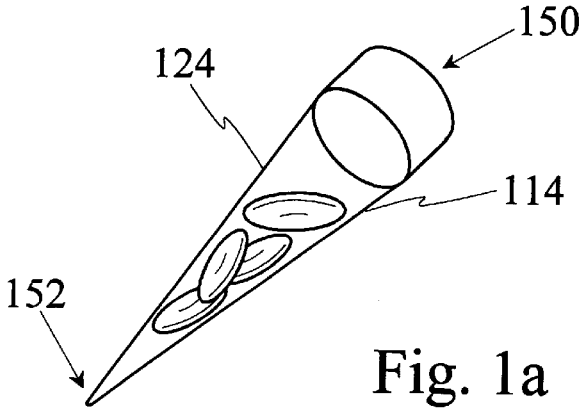
FIGS. 1*a* and 1*b* are perspective views of a dispenser in accordance with the invention.
Figure 1B:
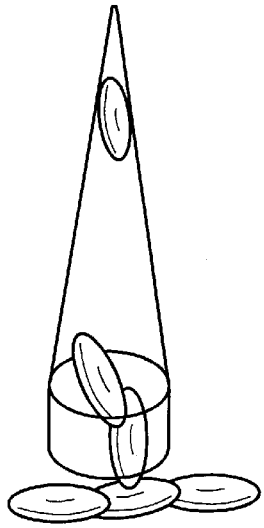

Referring to FIGS. 1*a* and 1*b*, a pill dispenser 114 according to the instant invention, is shown. The dispenser 114 comprises a receptacle having an open end 150 for receiving pills therethrough, a closed end 152 from which the pills are prevented from exiting, and a cavity defined by an internal surface 124 of the receptacle, extending from the open end and converging at the closed end e.g. at the apex 152. The cavity is designed with a depth sufficient for accommodating one or more of the pills therein. The shape of the cavity is characterised in that at least part of the internal surface 124 defines a region near the apex wherein a single pill becomes engaged when the dispenser 114 is tipped with the closed end point downwards, and retained therein with the dispenser 114 is tipped with the closed end pointed upwards.

In use, the dispenser 114 is coupled to a container for containing at supply of pills, the open end of the receptacle engaging an open end of the open end of the container. To dispense a pill from the container, the user tips the container to an angle whereby at least a portion of the contents is distributed into the dispenser (as in FIG. 1*a*). The pills accumulate within the dispenser, some near the closed end 152, normally forcing a single pill into a region proximate the apex of the cavity. The angle of convergence near the apex is selected such that this single pill becomes wedged therein, because of the forces exerted on the pill e.g. gravity and the weight of the remaining pills. In many instances, it is desirable to 'shake' the assembly to provide additional force and ensure that a pill is wedged within the apex. When the dispenser 114 is returned to an upright position, i.e. with the closed end 152 of the dispenser pointing upwards, (as in FIG. 1*b*) all of the pills except the single wedged pill, return to the container. The single wedge pill is retained within the apex of the dispenser, as a result of the frictional forces between the internal surface of the receptacle and the surface of the single wedged pill. The pill is dislodged from the dispenser 114 in any manner that overcomes the forces retaining the pill e.g., lightly tapping the dispenser 114 against another object, tapping the closed end 152 of the dispenser, deforming the apex to an extent that the internal surface 124 no longer exerts pressure on the pill, using an elongated member to push the pill out, etc.

Dispensers constructed with a flexible plastic or rubber material are particualry well suited for embodiments of this invention. Other materials are also suitable, provided a sufficient amount of friction is present between the pill and the internal surface of the dispenser. Alternatively, the internal surface is textured to assist in retaining the pill.

The cavity, described as extending from the open end 150 of the receptacle and converging at an apex 152, does not have to converge to a sharp point. It is sufficient that the angle of convergence defined by the internal surface 124 of the receptacle allow pills of various shapes and sizes to become engaged and trapped therein, one at a time. In defining pills of various sizes or pills having different sizes, the term "sizes" as used herein, refers to any measurement and/or dimension of the pill, and includes but is not limited to the maximum width and/or length of the same.

In other words, at least a portion of the internal surface 124 defining the cavity is tapered to an extent that at least a portion of a single pill enters, experiences pressure from the surrounding walls, and becomes temporarily retained or trapped. Of course, the use of converging sidewalls has the additional benefit of generally limiting a number of trapped pills to one. A V-shaped groove would also trap a single pill, but is more likely to trap a plurality of pills The term pill as used herein, refers to any small object, such as a pellet, tablet, capsule, etc, being dispensed one at a time from the container. It is not necessary for the small object to be symmetrical. Obvious examples include prescription over-the-counter drug, vitamins, mints, mouth fresheners, candies, beads, seeds, nut and bolts, etc.

The essence of this invention is the boundary to pill movement. In the embodiment illustrated in FIGS. 1*a* and 1*b*, the approximately conical or frusto-conical shape of the dispense serves to limit the number of pills engaged or dispensed, to one at a time. The unique conical shape of the dispenser accomodates pills of various shapes and sizes. However, the invention is not limited to the embodiment illustrated in FIGS. 1*a* and 1*b*. In another embodiment the apex of the approximately conical or frusto-conical receptacle is not closed. In yet another embodiment, various shapes, including those obtained by varying the depth of the cavity, and/or the angle of convergence are used to achieve desired results. For example, a pyramid or another polyhedron defines a basic shape having similar properties to a cone shaped cavity. Alternatievly, a horn-shaped cavity is used. Since the essence of the invention is the boundary to pill movement, the aforementiond shapes need only describe space in which the movement of the pill is limited to reduce a number of pills to one pill reaching a location wherein the pill is trapped. As noted in the figures, the reduction and trapping of a single pill is generally performed absent moving parts within the bounded area. The space can be defined by any boundary e.g., a wire grid, a solid interface, a series of projections, etc.

Figure 2:
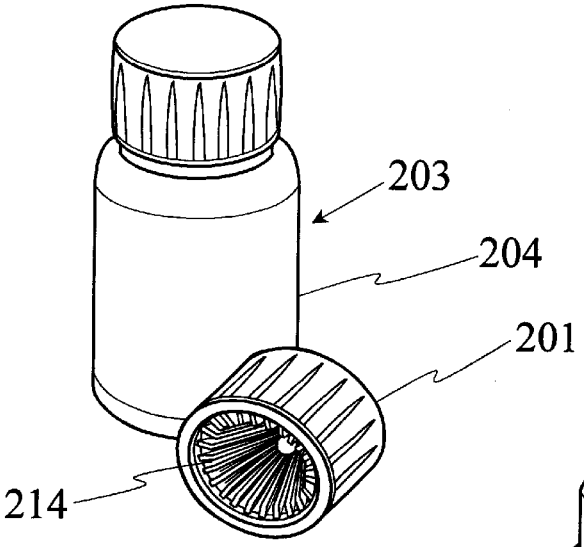
FIG. 2 is a perspective view of a dispensing cap and container for mounting the cap thereon, in accordance with an embodiment of the invention.

In another embodiment of the invention, shown in FIG. 2, the dispenser is integrally molded within a cap 201, which is mountable to a commercial container 204. The dispenser comprises a number of longitudinal projections extending from the inside of the cap, which serve to create a cavity for engaging a single pill therein, and for gripping said single pill, as shown in FIG. 2. The spacing between the longitudinal projections is small enough to exclude pills from engaging therein, and large enough to provide an appropriate gripping action on a trapped pill. The essence of the dispenser is described in the general embodiment disclosed above. The dispensing cap is constructed from a low cost plastic moulding, and is optionally mounted to the container in a childproof manner. To use the pill dispenser, the container, equipped with the dispensing cap, is tipped upside down. When the container is returned to its upright position, the contents of the container fall towards the cap, trapping a single pill within the cavity therein, as described in the general embodiment disclose above. The cap is detached from the container to reveal the single trapped pill resting in the cavity within the cap (shown in FIG. 2). A simple tap on the top of the cap dislodges the pill from the cap, releasing the pill into the hand of the user for immediate use. The simple motions of inverting the container, removing the lid, and tapping the top of the cap, are extremely natural. This sequence is performed quickly and easily, and is likely to appeal to many individuals. Since the dispenser is located within the cap, the user still has the option of dispensing one or more pills at a time directly from the container. Since the dispenser is arranged on the inside of the cap, there is little likelihood of the dispenser being damaged or broken. Furthermore, the internal positioning of the dispenser is very unobtrusive. From the outside, the dispensing cap resembles a conventional container cap. Advantageously, a company choosing to produce this one-at-a-time pill dispenser need only manufacture the dispensing cap, since the cap is designed to fit any predetermined bottle. It is important not to have to change the shape, size, or design of commercial containers, since the company may have invested a lot of time and money in associating a specific design with their product. This one-piece dispensing cap is easy to manufacture and inexpensive to produce. In fact, the manufacturing cost of this dispensing cap is low enough for companies to incorporate it into the cheapest over-the-counter medication.

Figure 3:
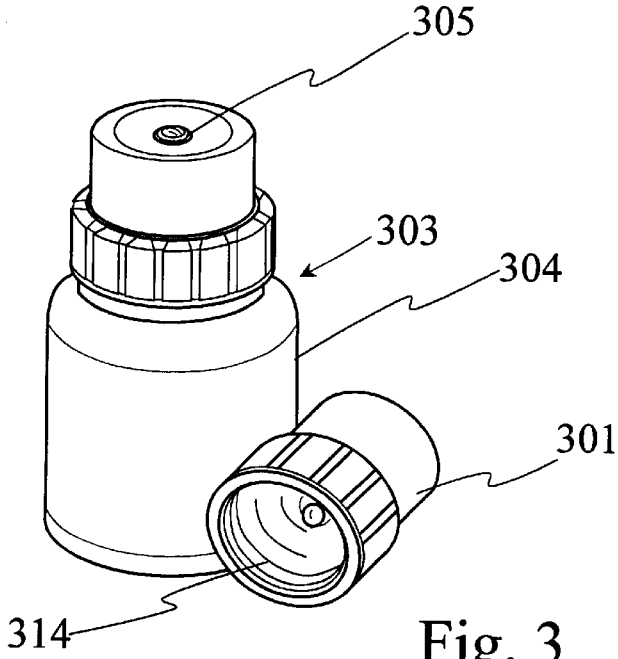
FIG. 3 is a perspective view of a dispensing cap and container for mounting the cap thereon, in accordance with another embodiment of the invention.

In another embodiment of the invention, shown in FIG. 3, a dispenser in the form of a soft, flexible insert 314 is secured within a cap 301, the cap mountable to a container 304 for containing a supply of pills. The cap 301 has a hole centred within its top portion, for accommodating a protruding portion 305 of the soft, flexible insert therein. The protruding portion 305 corresponds to the external portion of an apex of the cavity, the essence of which is described in the general embodiment disclosed above. To use the pill dispenser assembly 303, the container 304, fitted with the dispensing cap 301, is tipped upside down. The contents of the container 304 fall into the cap 301, trapping a single pill in the cavity therein. The cap 301 is detached from the container 304 to reveal the single trapped pill resting in the cavity within the cap (shown in FIG. 3). The pill is dislodged from the cap 301 when the user depresses the protruding portion 305 of the dispenser, which deforms under pressure and releases the pill. The pill is released because depressing the protruding portion 305 deforms the advantageously shaped apex to the point that the internal surface no loner exerts sufficient pressure on the pill to retain it e.g. the shape of the closed end is approximately conical in the receiving mode of operation and approximately rounded in the dispensing mode of operation. The advantages of this embodiment are that a soft, flexible material having a surface providing substantial friction for holding the pill more securely is used, and that the mechanical ejection ensures easy removal of the pill. The two piece construction is more expensive to manufacture than the one-piece construction described above, but is still fairly inexpensive. Optionally, the dispensing cap 301 is mounted to the container 304 in a childproof manner. In an alternate embodiment, the dispensing cap 301 is equipped with an additionally member for communicating between the top of the cap and the trapped pill e.g. a rod shaped member positioned outside the cap and extending longitudinally through the hole, passing through the apex of the dispenser and to a position within the dispenser wherein a force applied to the rod forcibly pushes the pill loose.

Figure 4:
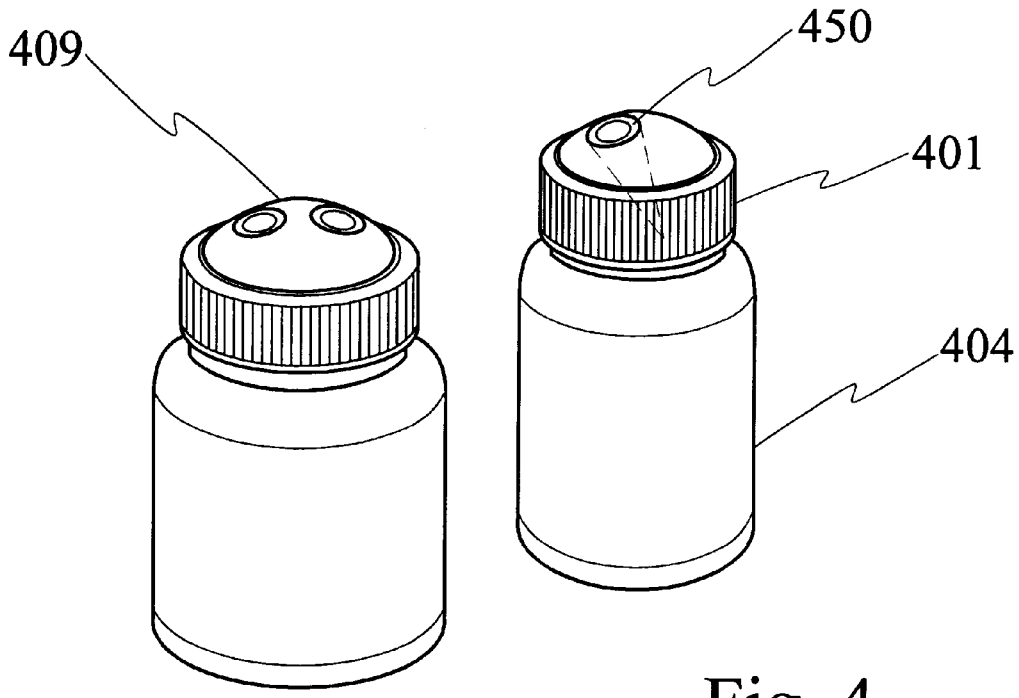
FIG. 4 is a perspective view of a dispensing cap and container for mounting the cap thereon, in accordance with another embodiment of the invention.

Another embodiment of the invention is shown in FIG. 4. The dispenser is positioned within a spherical member 409, the spherical member rotatably mounted within an opening of a cap 401, and the cap mountable to a container 404 for containing a supply of pills. The spherical member 409 rotates within the cap 401 to selectively expose or conceal the open end of the receptacle 450 disposed therein. The essence of the dispenser in this embodiment is described in the general embodiment disclosed above. Normally, the spherical member 409 is arranged to maintain the open end of the dispenser 414 towards the inside of the container 404, to which the cap is secured. In this pill-receiving mode of operation, the container is closed to the external environment. When the combined container 404 and cap 401 are turned upside down, the contents of the container slide towards the cap 401. When at least a portion of the contents has accumulated in the cap 401, with one pill trapped within the apex of the dispenser, the container and cap are returned to an upright position. The contents return to the container 404, with the exception of the trapped pill. The spherical member 409 is rotated until the open end of the receptacle 450 is exposed to the region outside the container 404. In this pill-dispensing mode of operation, the pill, which is visibly trapped within the apex of the receptacle, is freed with a light tap to the assembly. Since the lid is not removed, the pills are dispensed faster and easier. Alternatively, the pills are dispensed with the aid of a mechanical 'tapper' for increasing the automation of the pill-dispensing procedure.

Optionally, the spherical member is textured to aid in rotating the same, and/or as a visual indication of the location of the open end of the receptacle 150. Further optionally, the rotation of the spherical member is guided with a biasing member e.g. a weight or a spring, or is equipped with locking means to normally bias the spherical member in a particular orientation. The present embodiment provides for an inherently childproof mechanism, since although the motions of inverting the container, rotating the spherical member, and tapping the assembly are entirely natural, the sequence is not immediately intuitive to children. Even if a child manages to remove one pill form the dispenser, it is highly unlikely that the same child would be able to repeat the procedure. Thus the damage that incurs when a child is able to ingest a large amount of material, packaged in pill form, is reduced when the present embodiment is used. Other advantages inherent with the present embodiment include a fast, rapid one-hand operation. The rotation of the spherical member is accomplished with a single finger or thumb, and does not require a difficult twisting motion. Since the pills secured within the container are accessed rapidly and conveniently, this embodiment is particualry attractive to users who require medicated pills for fast relief of medical ailments. Preferably, if the dispenser is required for large pills only, the cavity is more frusto-conical in shape than conical in shape, to ensure the spherical member is reasonably sized.

Figure 5:
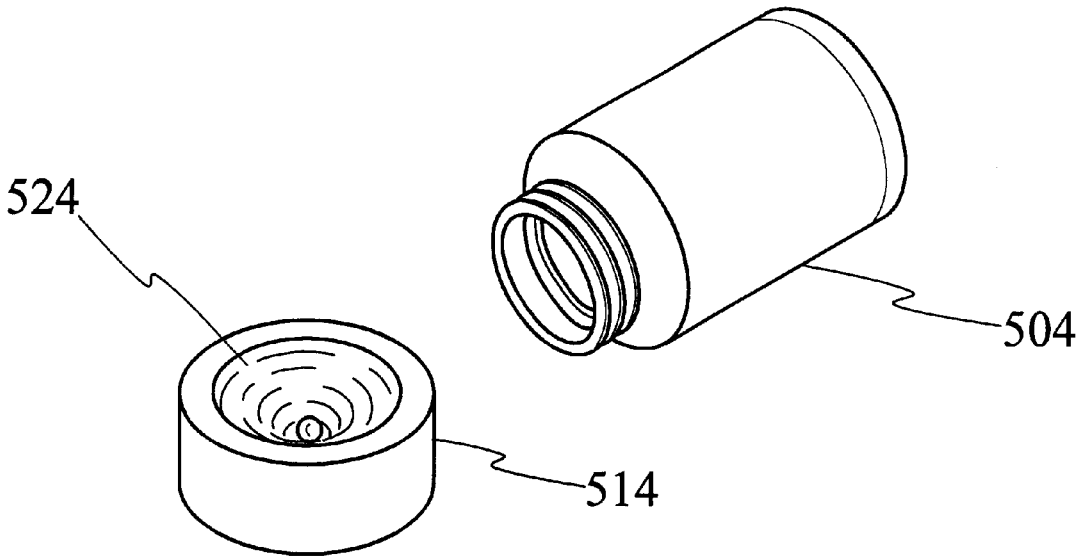
FIG. 5 is a perspective view of a dispensing cap and commercial container for mounting the cap thereon, in accordance with another embodiment of the invention.

In another embodiment of the invention, shown in FIG. 5, a soft, flexible dispenser 514 in the form of a cup is provided. The dispensing cup 514 is constructed to suit a variety of commercially available containers 504, equipped with conventional caps 501. The cup has a cavity therein, defined by an internal surface 524 of the cup, extending from an open end and converging at a closed end e.g. at an apex. The essence of the cavity in this embodiment is the same that described in the general embodiment disclosed above (FIGS. 1*a* and 1*b*). To use the dispensing cup, the conventional cap 501 is removed from the container, and the dispensing cup is placed on the container with the open end facing the interior of the container. Together the container and cup are turned upside down until a portion of the contents of the container fills the cavity within the cup, trapping a single pill therein. The remaining pills are returned to the container when the cup and container are returned to the upright position. To release the single trapped pill to the hand of the dispenser user, the cup is removed from the container, and the top of the cup is depressed. Alternatively, and perhaps more effectively, pressure is applied to the sides of the cup i.e., the cup is squeezed, to release the pill. The act of squeezing the cup, deforms the advantageous conical shape of the cavity, and allows the retained pill to slip away. This dispensing cup is for use with any commercial pill container, in particular, it is for use with any commercial pill container not equipped with a one-at-a-time pill dispensing cap. The pill dispensing cup is preferably advantageous for providing a safe, sanitary, and easy way to use way of dispensing pills one at a time. The dispensing cup is very inexpensive to produce.

Figure 6:
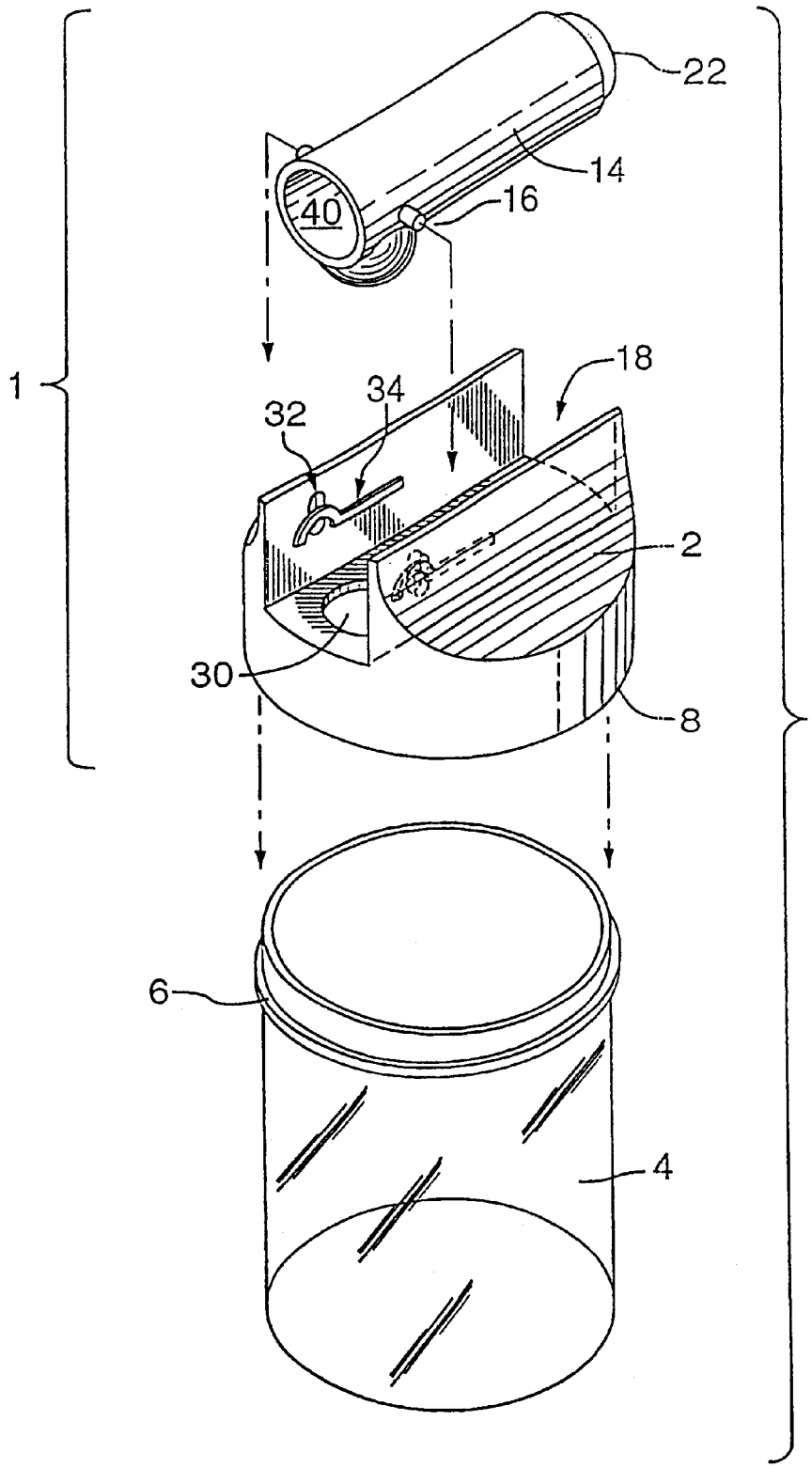
FIG. 6 is an exploded perspective view of an assembly comprising a dispensing cap and a container for mounting the cap thereon, in accordance with another embodiment of the invention.
Figure 7:
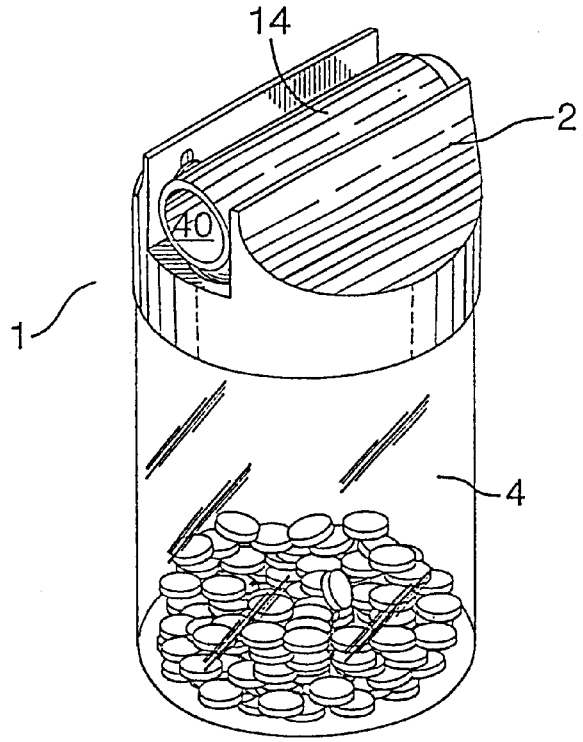
FIG. 7 is a perspective view of the assembly, in accordance with the embodiment illustrated in FIG. 6.
Figure 20:
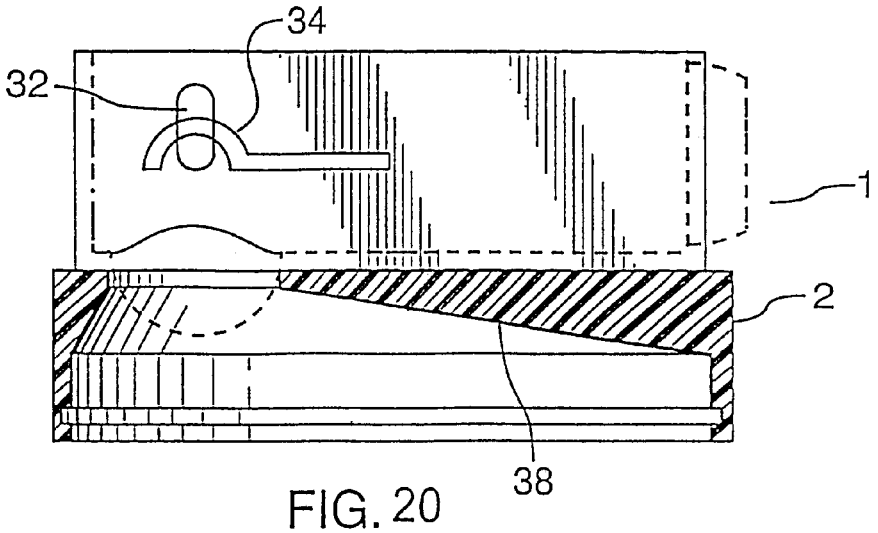
FIG. 20 is the side view of FIG. 19 showing the dispenser in ghost.
Figure 19:
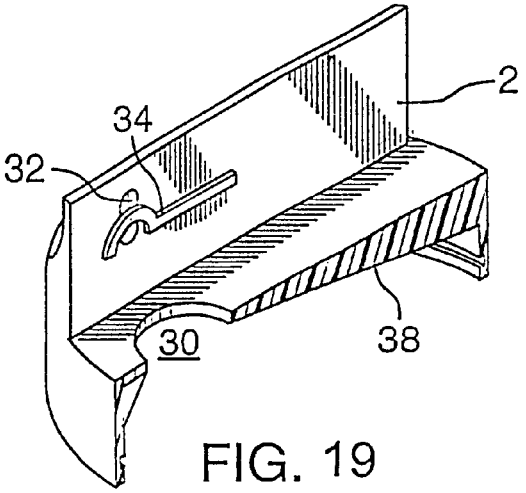
FIG. 19 is a perspective view of the dispensing cap showing the biasing means.
Figure 21:
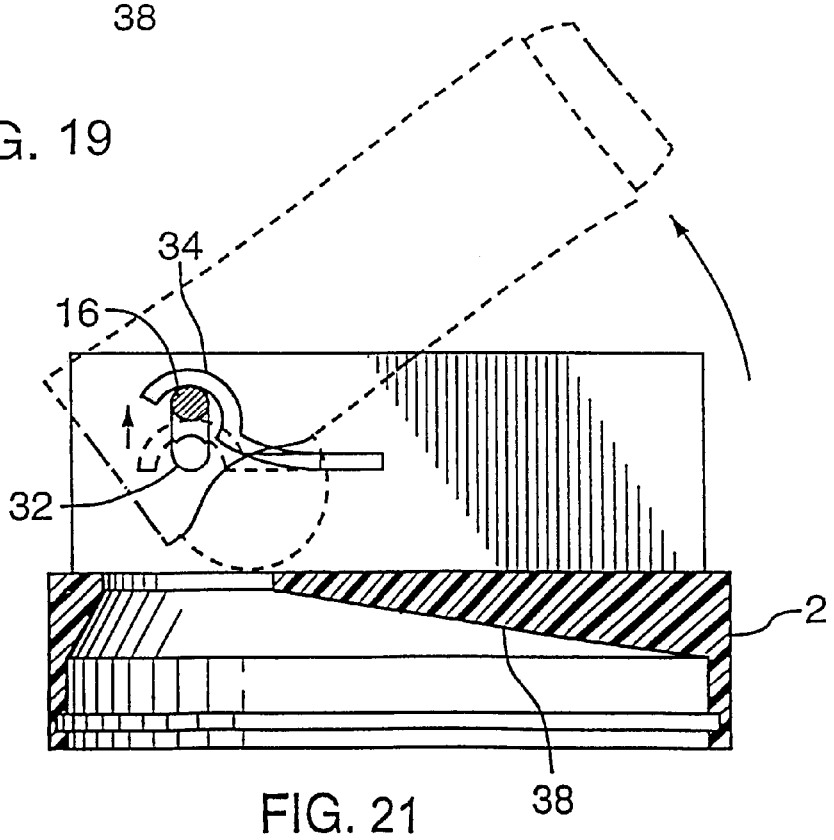
FIG. 21 is the side view of FIG. 19 showing the operation of the biasing means and pivot in operation.

Another embodiment of the invention is shown in FIGS. 6–21. A pill dispensing cap assembly 1 is demountably fastened on the open neck of a pill container 4. In the particular embodiment disclosed herein, the dispensing cap assembly 1, as shown in FIG. 6, comprise a two component design, namely, a pivotable dispenser 14 and a base 2 to pivotably receive the dispenser thereon. The essence of the dispenser is the same as the dispenser described in the general embodiment disclosed above. The dispenser 14 has a cavity 40, defined by an internal surface 24. The cavity 40 has an open end with which pills are received therethrough when the dispenser is in a pill receiving position, and with which a pill is dispensed when the dispenser is in a pill dispensing/resting position. The dispenser 14 is pivotably mounted to the base 2, within a recessed area 18 on a top end of the base. The recessed area has two opposite facing sidewalls and a horizontal surface having a hole 30 extending through the base. As shown in FIGS. 19–21, on each sidewall there is a vertical slot 32 of sufficent width and depth to receive pin 16. Integrally molded on the face of each sidewall is a downwardly biaising spring element 34 that extends past the slot 32, preferably, in a downward hook fashion. The distance between the pin engaging surfaces of the hook and slot is of sufficent space to receive and secure pin 16 in constant communication with the slot. Optionally, other downwardly biasing spring elements are provided to achieve the same results and still fall within the scope of the invention. For instance, the spring element may be linearly shaped through its length instead of being hook shaped at the point of contact with the pin. The dispenser is pivotally connected to the base 2 with two axially aligned pins 16, which extend outwardly into the slots 32. Each pin is integrally molded on a lateral surface of the dispenser 14. The pivoting action of the pins is further expanded to include limited vertical movement provided by slots 32. The integrally molded spring elements 34 naturally bias the pins 16 in a downward vertical direction. The combined pivoting-vertical action of the pins allows the dispenser to be switched between stable pill receiving and pill dispensing positions.

The dispenser 14 shown in FIGS. 7–11 is in a pill dispensing/rest position. In this position, the dispenser rests substantially horizontally in the recessed area 18. When the dispenser is in the dispensing position, the semi-spherical cam 26 mates with hole 30, as shown in FIGS. 7–11, thereby locking the dispenser in a horizontal resting position. Once the hole is closed by the cam 26, pills in the container cannot exit through the hole 30.

Figure 8:
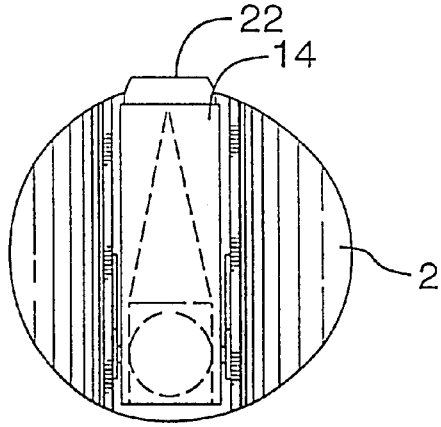
FIG. 8 is a top view of FIG. 7.
Figure 9:
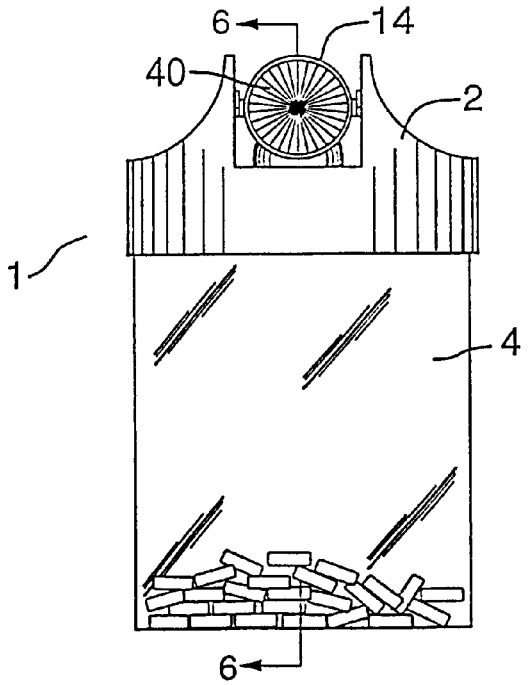
FIG. 9 is a front view of FIG. 7.
Figure 10:
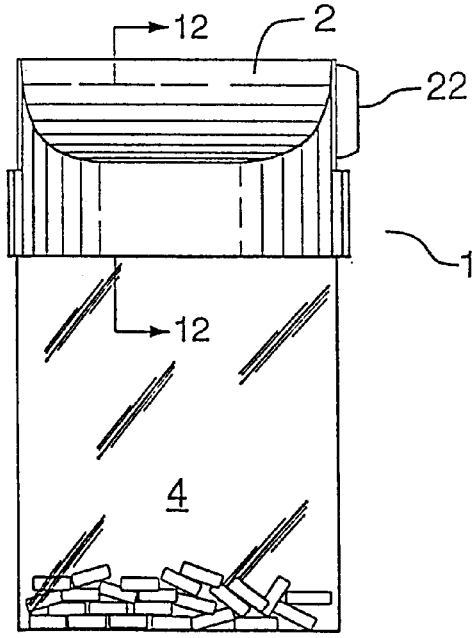
FIG. 10 is a right side view of FIG. 7.
Figure 11:
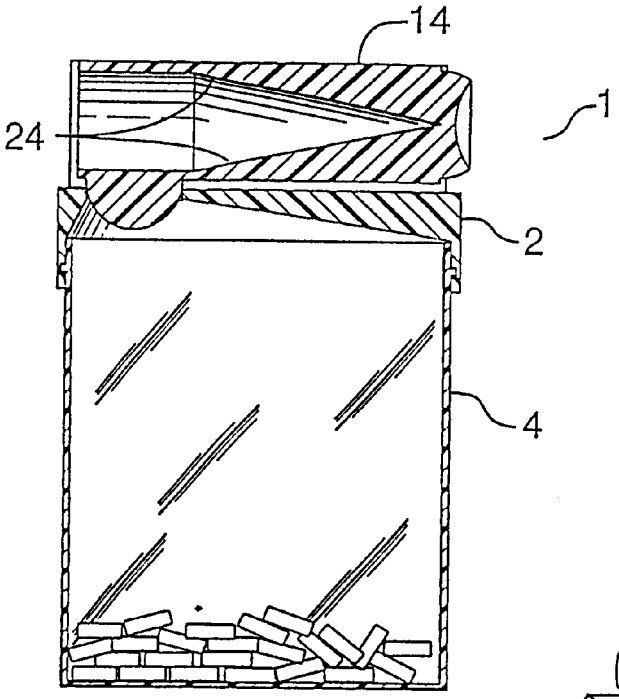
FIG. 11 is a sectional view along line 6—6 of FIG. 9.
Figure 12:
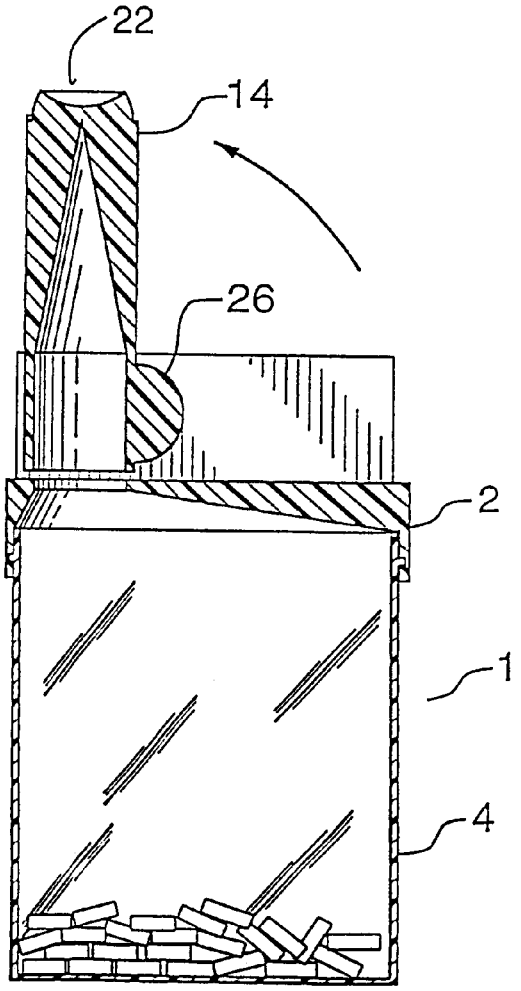
FIG. 12 is a sectional view along line 6—6 of FIG. 9, showing the dispenser in an upright position.
Figure 13:
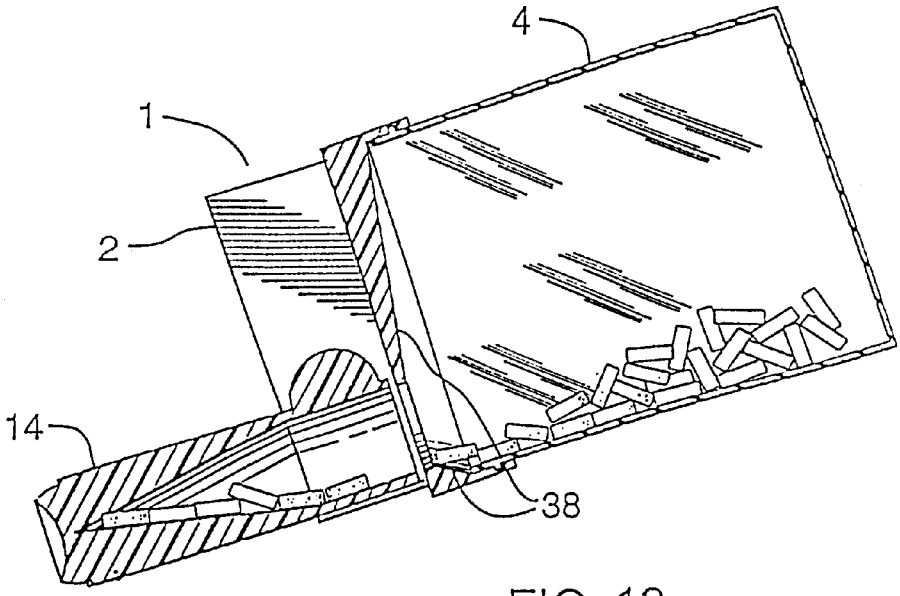
FIG. 13 is a sectional view along line 6—6 of FIG. 9, showing the assembly tilted.
Figure 14:
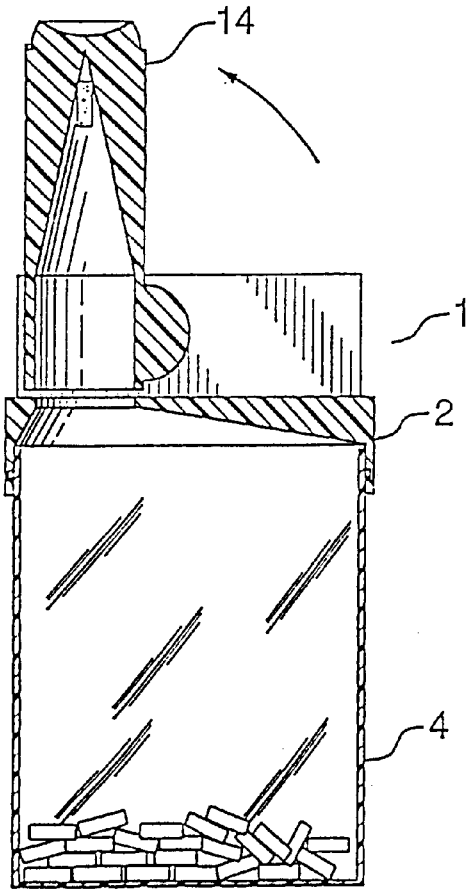
FIG. 14 is a sectional view along line 6—6 of FIG. 9, showing the assembly returned to its upright position and having a pill engaged in the conical net.
Figure 15:
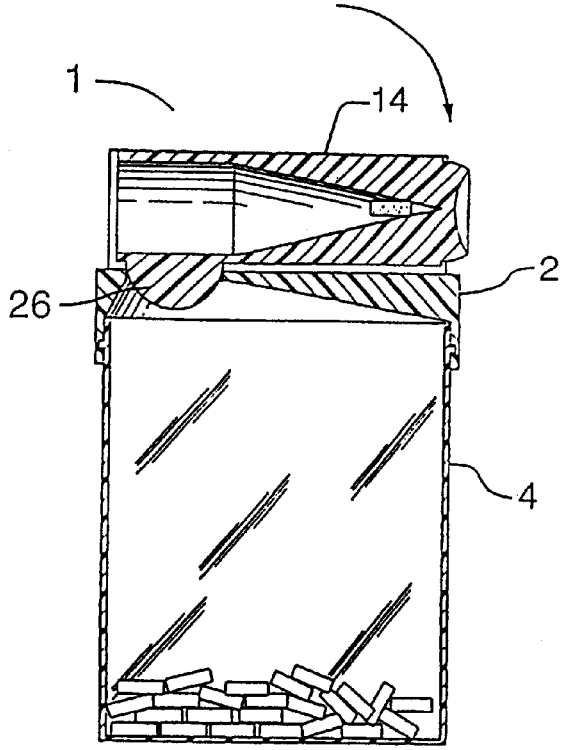
FIG. 15 is a sectional view along line 6—6 of FIG. 9, showing the dispenser returned to its rest position.

The dispenser 14 shown in FIGS. 12–14 is in a pill receiving position. In this position, the dispenser rests in an upright position, with the closed end of the dispenser pointed upwards. As shown in FIG. 8, the dispenser has a lifting end, including an actuator 22. When the dispenser is lifted to its upright position, the downward biasing element locks the dispenser in place, with the flat edge of the dispenser abutting the horizontal surface of the base above the hole 30, providing means for communication between the cavity within the dispenser and the interior of the container. As shown in FIG. 13, a taperd surface 38 is provided on the bottom side of the base. This tapered surface encourages the loosely stored pills resting on the tapered surface to slide towards the hole 30, when the container is tilted from its upright position.

Figure 16:
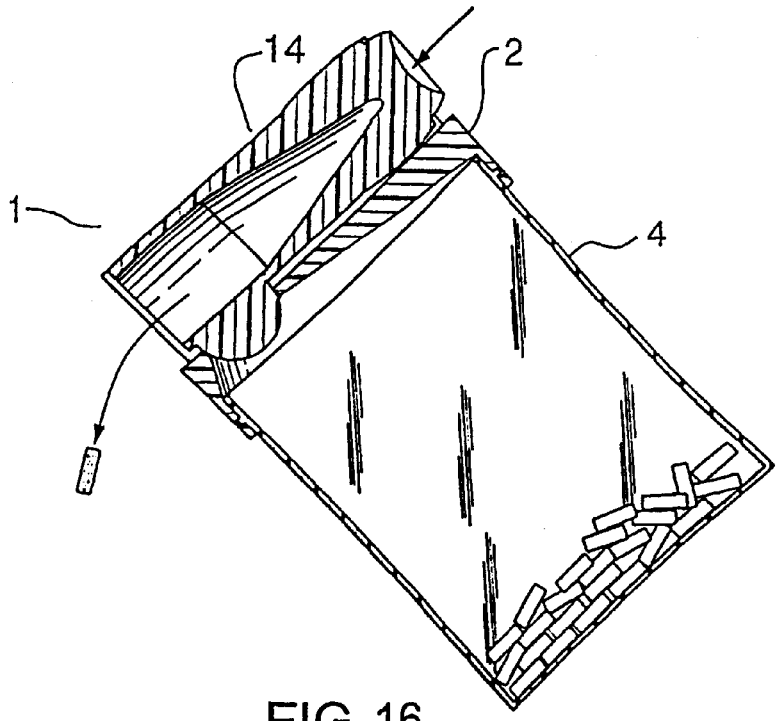
FIG. 16 is a sectional view along line 6—6 of FIG. 9, showing the assembly tilted and the ejection of the engaged pill.
Figure 17:
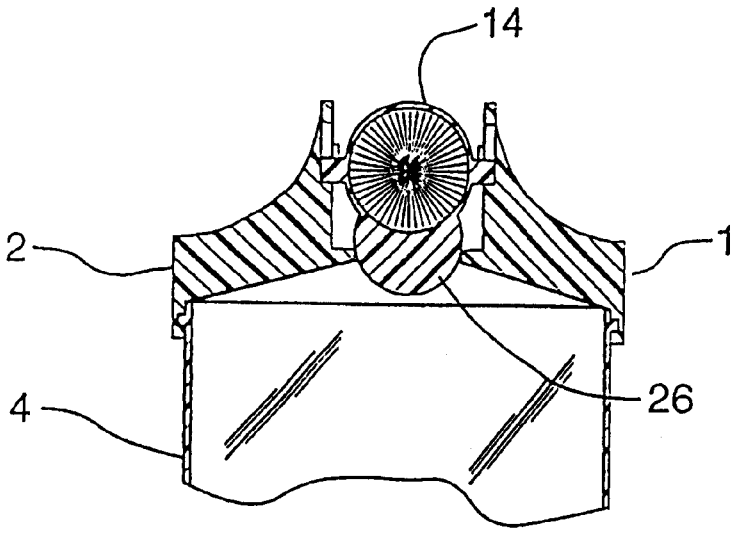
FIG. 17 is a sectional view along line 12—12 of FIG. 10.
Figure 18:
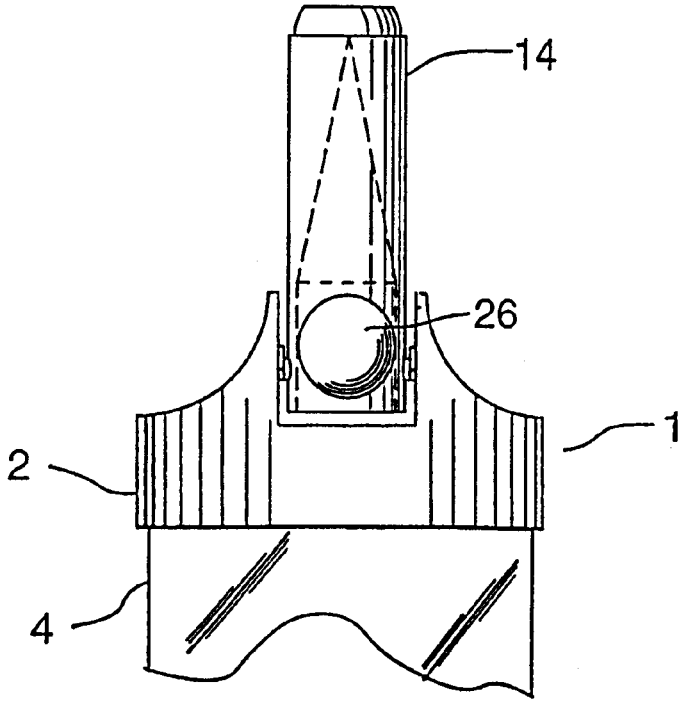
FIG. 18 is a rear view of the assembly with the dispenser in an upright position.

The sequence of steps to dispense one pill from the container using the pill dispenser is illustrated in FIGS. 11–16. First, the user pivots the dispenser from the horizontal dispensing position (resting position) shown in FIG. 11, to a vertical receiving position shown in FIG. 12, by manually raising the closed end of the dispenser so that the dispenser pivots about pins 16. When the dispenser reaches the full upright position, the dispenser is located in the vertical position by the biasing spring elements 34. The hole 30 provides means for communicating between the cavity within the dispenser and the interior of the container. The user tilts the container to encourage the pills therein to slide towards the hole 30, as shown in FIG. 13. When at least one pill is engaged in the tip of the dispenser, the container is returned to an upright position as shown in FIG. 14. All of the pills, except for the single pill retained in the apex of the dispenser, fall out of the dispenser and return to the container 2 through hole 30. The dispenser is returned to the resting position shown in FIG. 15. To release the pill, the actuator 22 is lightly tapped or depressed. FIG. 16 shows how depressing the actuator deforms the internal surface of the dispenser, reducing or removing the pressure exerted on the pill from the internal surface, thus causing the pill to be released. In other words, the dispenser is approximately conical in shape in a first resting mode of operation, and roughly forms a half arch in a second dispensing mode of operation.

The present embodiment is particualry advantageous, since the flip-flop mechanism is easy to operate, manoeuvrable with one hand, and highly effective. The motions required to obtain a single pill are natural, controlled, and quick to perform. In fact, the flipping motion is particularly easy for almost all users. The flip top mechanism of present embodiment has the unforeseen advantage of appearing fun to operate.

Figure 22:
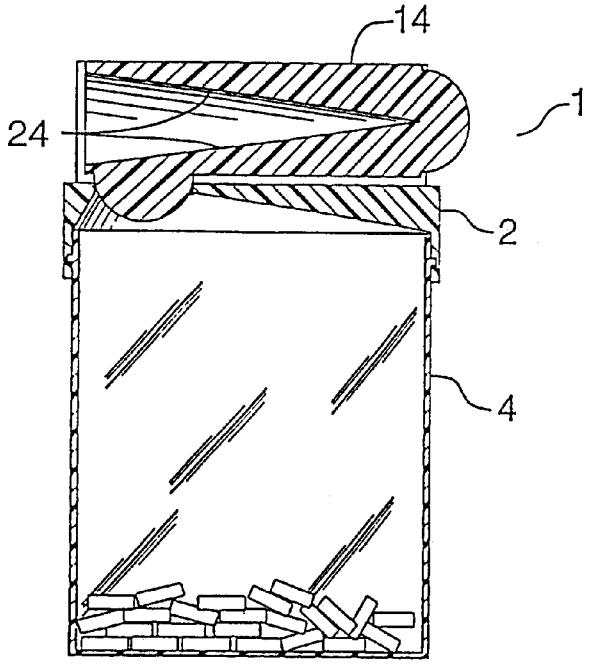
FIG. 22 is a sectional view along line 6—6 of FIG. 9 showing an alternate embodiment of the conical cavity in the dispenser.
Figure 23:
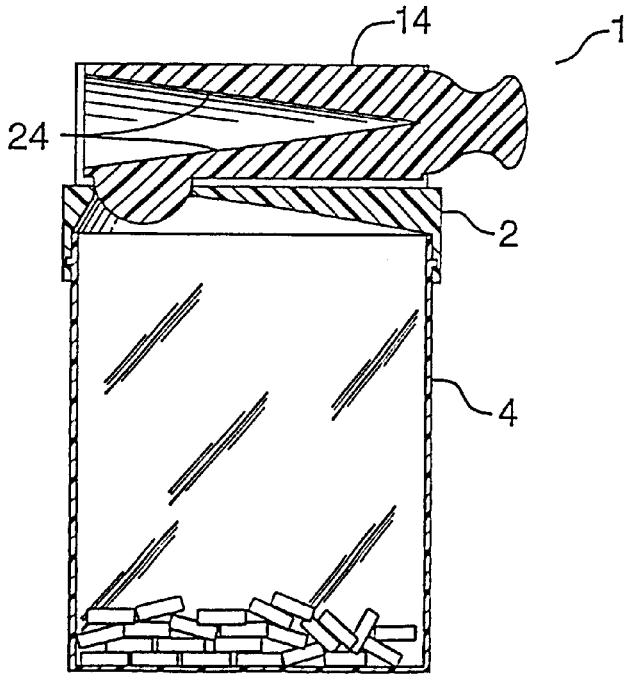
FIG. 23 is a sectional view along line 6—6 of FIG. 9, showing the alternative embodiment of the actuator.

In the present embodiment, the dispenser is represented as an approximately cylindrical member with an approximately conical cavity. The approximately conical shape of the cavity allow a single pill to become engaged in the apex thereof, and retained therein until an external force is applied thereto. In the embodiment illustrated in FIG. 11, a short cylindrical portion of the cavity extends from the open end and merges with the conical portion. The external force is applied the actuator 22, positioned close to and in contact with the apex of the cavity. FIGS. 22 and 23 show alternative embodiments of the dispensing apparatus. In these embodiments, the conical portion of the cavity commences from the edge of the cavity opening. Alternatively, the actuator takes various other forms. In another embodiment, the dispenser 14 is not cylindrical in shape, but rather mirrors the conical shape of the cavity. In another embodiment, the dispenser is essentially transparent and the user has visual contact with the pill inside the cavity.

In one embodiment of the invention, the container is replenished with additional pills by disengaging the pill-dispensing cap from the container, and pouring the pills therein. In another embodiment, the dispensing cap assembly is integrally moulded with the contained (not shown). The container is thus disposable, or is replenished with pills using a flip-top connection that separates the dispensing cap assembly from the container.

In each of the embodiments described hereto, the dispenser is optionally mounted to the container in a childproof manner. FIG. 6 shows a child proof screw and thread combinations along the engaging peripheral edges of the bottom portion 8 of the dispensing cap assembly and the open neck portion of the container 6.

Figure 24:
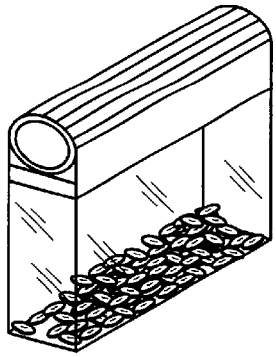
FIG. 24 is a perspective view showing an alternative embodiment of the container and dispenser.

Furthermore, in each of the embodiments described hereto, the dispenser has been described as being coupled to a commercial container containing a supply of pills. The dispenser is operable with any shaped container, and is not limited to the round neck containers illustrated in FIGS. 2–23. FIG. 24 shows the dispensing cap described in the latter embodiment coupled to a rectangular container.

Figure 25A:
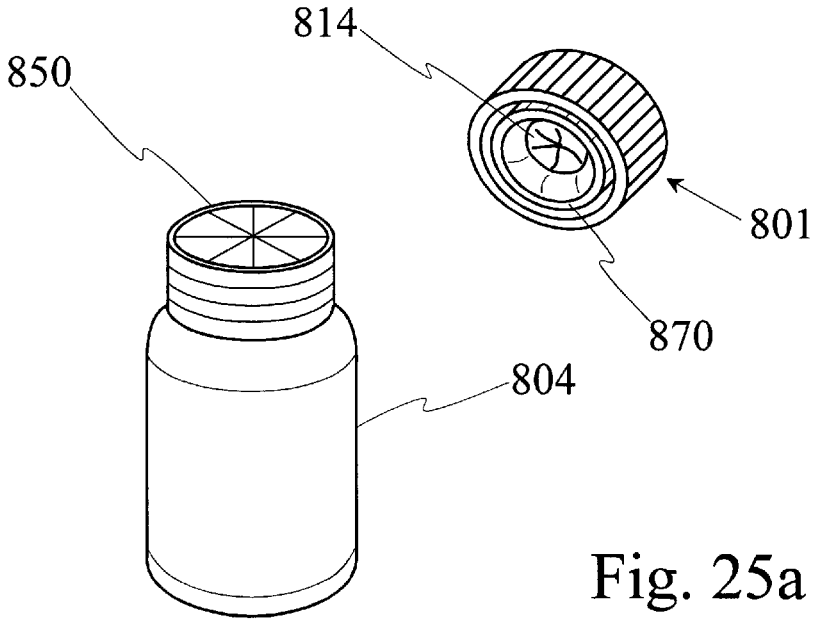
FIG. 25*a* is a perspective view of a dispensing cap and container for mounting the cap thereon, in accordance with another embodiment of the invention.
Figure 25B:
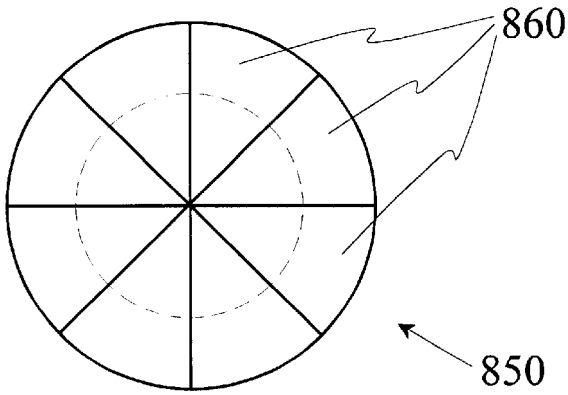
FIG. 25*b* is a top plan view of a cover for the container in FIG. 25*a;*
Figure 25C:
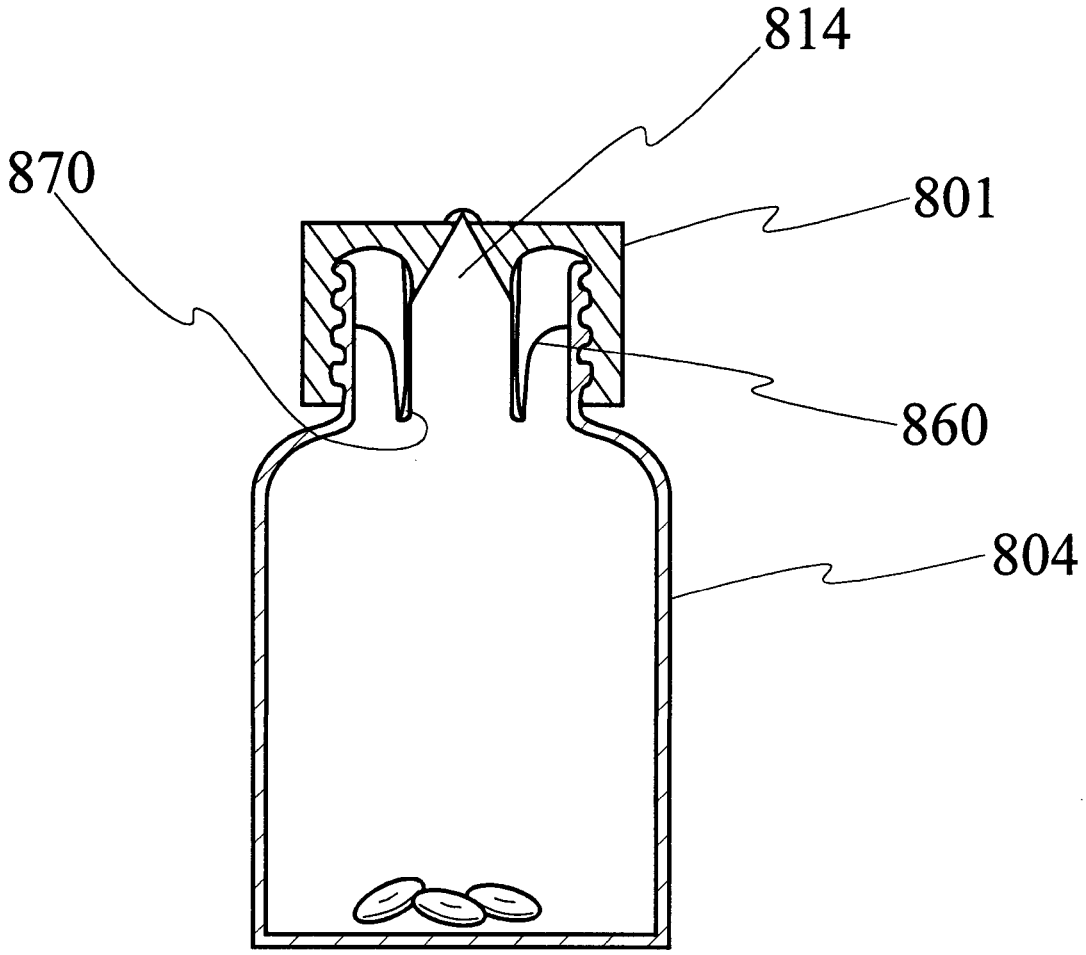
FIG. 25*c* is a cross-sectional side view of the dispensing cap and container of FIG. 25*a* in assembly.

In another embodiment of the invention, shown in FIG. 25*a*, a soft, flexible flange 850 having a plurality of teeth 860 is coupled to the neck of the container 804. The teeth 860 form a safety shield or barrier, to secure the pills within the container 804. A dispensing cap 801, having a dispensing portion therein 814, is mountable to the container 804. For example, the cap 801 is mounted with a screw or snapping mechanism. When the cap 801 is mounted on the container 804, the outside ridge 870 of the dispensing portion forces the downward facing tips of the teeth 860 away from one another and towards the centre of the container, thus allowing communication between the inside of the container 804 and the cavity within dispenser 814. In this pill receiving position, the container is tipped and/or shaken to trap a pill within the dispenser 814. For example, the ridge 870 is forced against the region defined with the dotted line in FIG. 25*b*, to force the tips of the teeth into a non-blocking position, thus opening the container 804. When the cap 801 is removed from the container the teeth return to the blocking position shown in FIG. 25*a*. The single trapped pill in the dispenser 814 is released by the user with a light tap or the like. FIG. 25*c* illustrates the dispensing cap 801 engaged with the container 804 in the pill receiving mode position. The present embodiment has the inherent advantage that the pills are not likely to leave the container in an accidental manner. Moreover, the teeth 860 provide a safety shield that makes it difficult for young children to acquire medication contained within the container. This inherently childproof mechanism is also beneficial to persons using the pill dispenser who suffer frequently from uncontrollable shaking movements, thus inadvertently spilling pills from the container, and/or those which have difficult manipulating small objects, and thus have difficulty retrieving pills which have fallen to a flat surface such as the ground or a table top. For example, many arthritic patients will find this embodiment particularly attractive.

Figure 26:
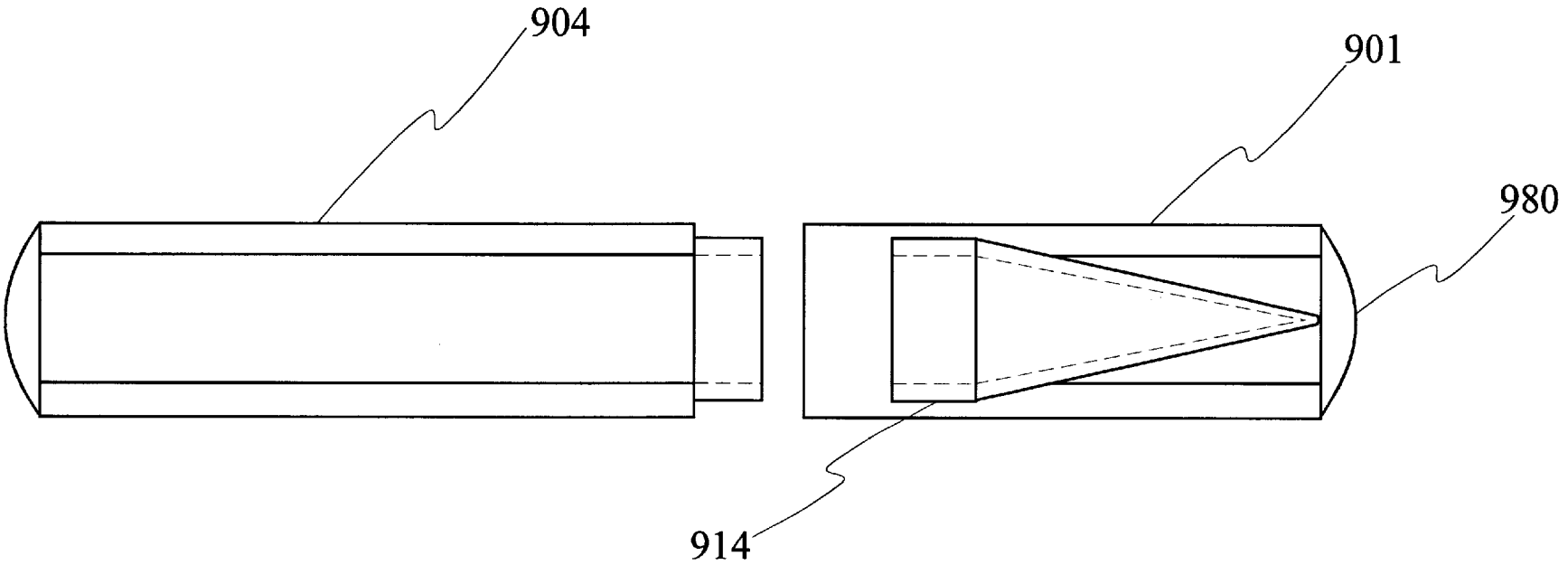
FIG. 26 is a side view of another embodiment of the pill dispenser having a pen-like design.

In another embodiment of the invention, shown in FIG. 26, a narrow dispensing cap 901 housing the dispenser 914 as described in the general embodiment above, is mountable on an elongated narrow container 904 for convenient transport in a pocket or purse. For example, the cap 901 is mounted with a screw, snapping, or childproof mechanism. Optionally, the cap 901 is fitted with a removable rubber nub 980, to provide means for deforming the apex of the dispenser 914 to an extent that a single pill trapped therein is dislodged. The convenient 'pen shape' provides a highly portable pill dispenser.

Figure 27A:
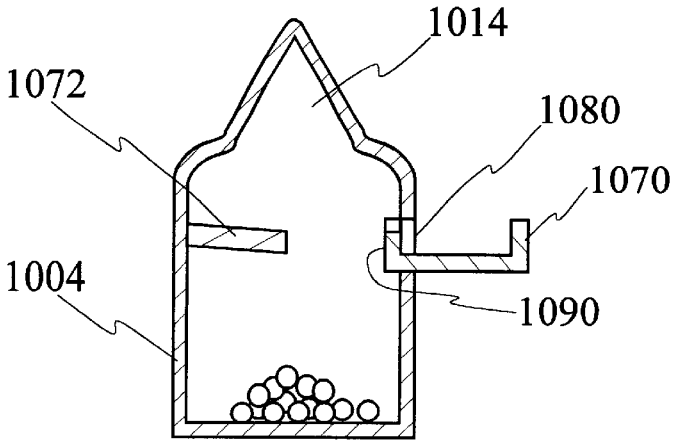
FIGS. 27*a–e* are cross-sectional views of the dispenser according to another embodiment of the invention showing the steps for acquiring a single pill.
Figure 27B:
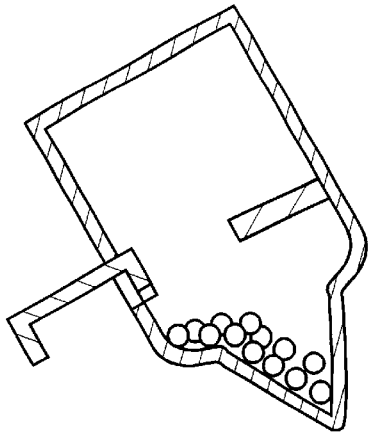
Figure 27C:
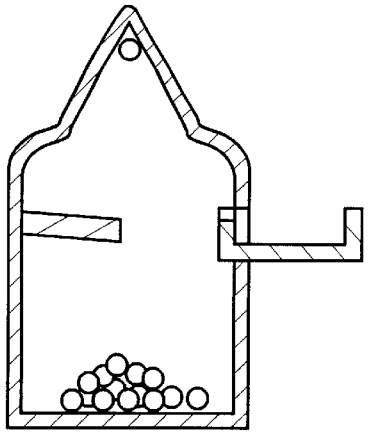
Figure 27D:
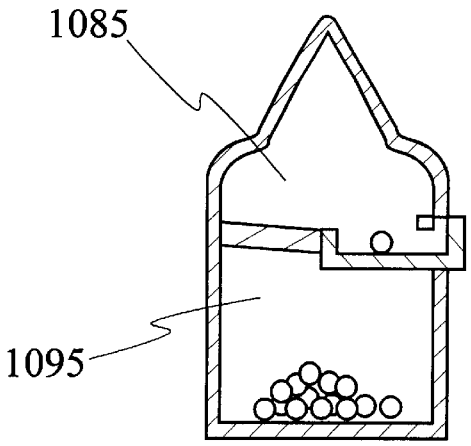
Figure 27E:
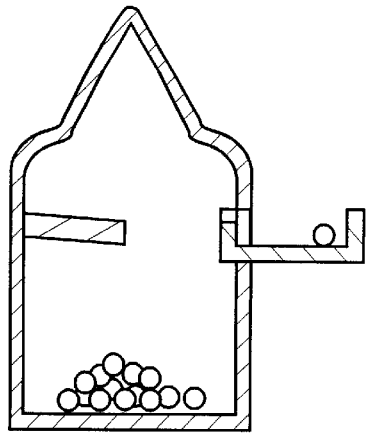

In another embodiment of the invention, shown in FIG. 27*a*, the dispenser 1014 is disposed directly in, or is an integral part of, the container 1004. Specifically, the receptacle 1014 is disposed in an upper region 1085 of the container 1004. A lower region of the container 1095 accommodates a plurality of pills. A moveable barrier 1070, for example in the form of a tray or drawer, is disposed at least partially, in an opening 1080 in the side of the container 1004. Normally, the moveable barrier 1070 is biased in an outward position, as shown in FIG. 27*a*. In this pill-receiving mode of operation, the drawer 1070 is normally biased such a portion 1090 of the moveable barrier 1070 closes opening 1080, thus preventing the pills from moving to the external environment. When the container 1004 is turned updside down as shown in FIG. 27*b*, the pills slide towards the receptacle 1014. When at least a portion of the pills have accumulated in the receptacle 1014, with one pill trapped within the apex of the receptacle 1014, the container 1004 is returned to an upright position. The non-trapped pills return to the lower region 1095 with the exception of the trapped pill, as shown in FIG. 27*c*. The essence of the dispenser 1014 in this embodiment is described in the general embodiment disclosed above. As shown in FIG. 27*d*, the drawer 1070 is moved towards the interior of the container 1004 to prevent communication between the upper 1085 and lower 1095 regions. Optionally, a further barrier 1072 is provided. In this pill-dispensing mode of operation, the pill, which is trapped within the apex of the receptacle 1014, is freed with a light tap to the assembly and falls into drawer 1070. Alternatively, the pill is freed when the user deforms the apex of the receptacle 1014, as described above. The single pill is removed from the drawer 1070 when the drawer 1070 is allowed to return to its normal outward position, as shown in FIG. 27*e*. Optionally, the drawer 1070 includes a ramp therein for easy dispensing of the pill. Further optionally, a second moveable barrier 1090 is used to normally close opening 1080.

Figure 28B:
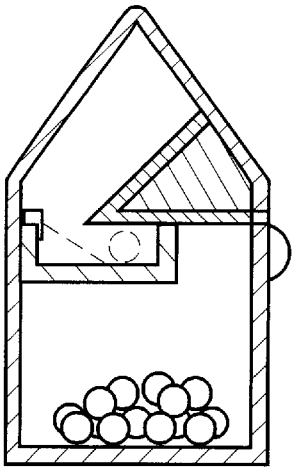
FIG. 28*b* is a cross-sectional view of the dispenser in FIG. 28*a* showing the drawer in a second position.
Figure 28A:
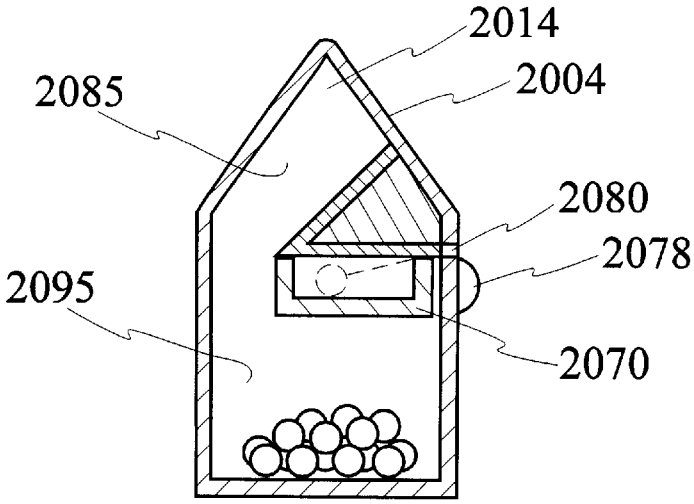
FIG. 28*a* is a cross-sectional view of the dispenser according to another embodiment of the invention showing a drawer in a first position on the inside the container.
Figure 28D:
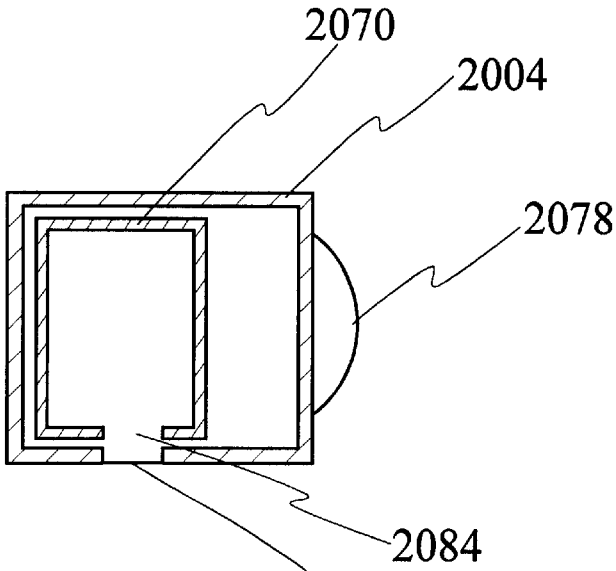
FIG. 28*d* is a top cross-sectional view of the dispenser of FIG. 28*a* with the drawer in the second position.
Figure 28C:
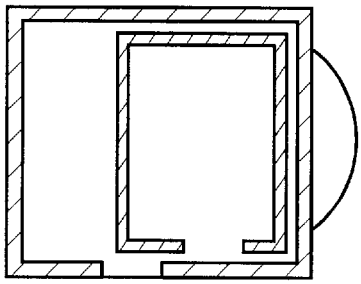
FIG. 28*c* is a top cross-sectional view of the dispenser of FIG. 28*a* with the drawer in the first position.

In a similar embodiment, shown in FIG. 28*a*, the drawer 2070 is disposed in the interior of the container 2004. As in the previous embodiment, the dispenser 2014 is disposed in the upper region 2085 of the interior of the container 2004. The lower region of the container 2095 accommodates a plurality of pills. The drawer 2070 is moveable from one side of the container 2004 to the other, such that a hole 2084 in the side of the drawer is alternates between being coaxial and non-coaxial with a hole 2080 in the side of the container, as shown in the top cross-sectional view in FIGS. 28*c*–*d*. An actuator 2078 is provided for moving the drawer 2070. The opening 2080, shown in phantom in FIG. 28*a*, is provided for selectively allowing pills to leave the container 2004. Normally, the drawer 2070 is biased against one side of the container, as shown in FIG. 28*a*. In this pill-receiving mode of operation, pills in the lower region 2095 are free to move to the upper region 2085 when the dispenser is angled accordingly, but are prevented from leaving the container through opening 2080 which is blocked by drawer 2070. When the container 2004 is turned upside down, the pills slide towards the receptacle 2014. When at least a portion of the pills accumulated in the receptacle 2014, with one pill trapped within the apex of the receptacle 2014, the container 2004 is returned to an upright position. The non-trapped pills return to the lower region 2095 with the exception of the trapped pill. The dispenser 2014 in this embodiment is described in the general embodiment disclosed above. When the drawer 2070 is moved to the other side of the container, as shown in FIG. 28*b*, the drawer 2070 acts as a barrier to prevent communication between the upper 2085 and lower 2095 regions. In this pill-dispensing mode of operation, the pill, which is trapped within the apex of the receptacle, is freed with a light tap to the assembly and falls into drawer 2070. Alternatively, the pill is freed when the user deforms the apex of the receptacle 1014, as described above. The single pill is dispensed via holes 2080 and 2084. Optionally, the drawer 2070 includes a ramp therein for easy dispensing of the pill.

Figure 29:
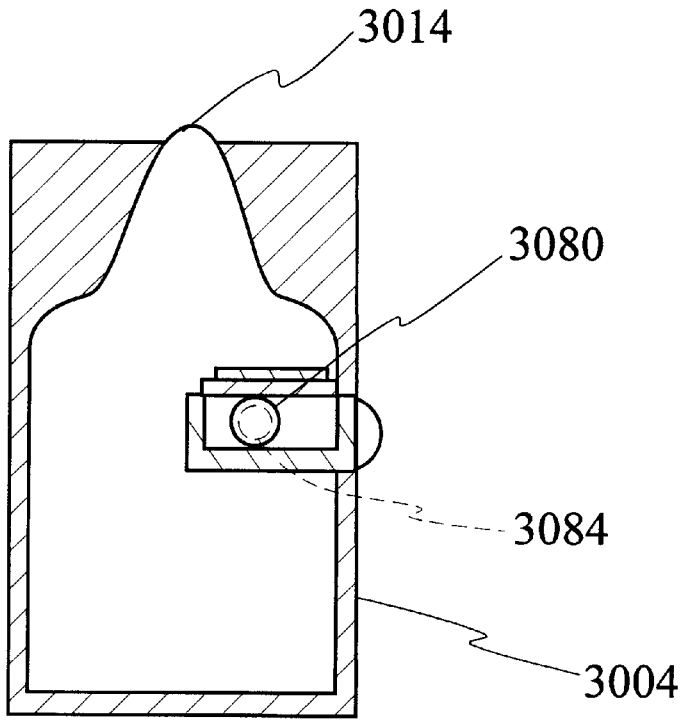
FIG. 29 is a cross-sectional view of the dispenser according to another embodiment of the invention; and, FIG. 30 is a cross-sectional view of the dispenser according to another embodiment of the invention.

An alternative design of the previous embodiment is shown in FIG. 29, wherein the holes 3080 and 3084, analogous to the holes 2080 and 2084 described above, are only aligned when the dispenser is in a pill receiving position.

Figure 30:
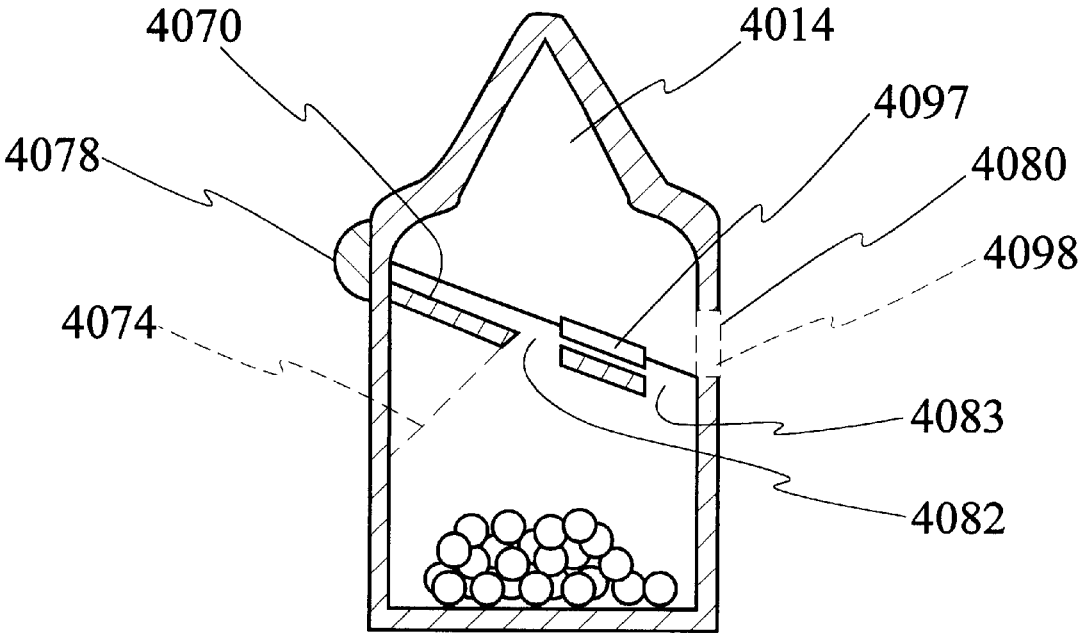

In yet another embodiment, shown in FIG. 30, the moveable barrier is in the form of a sheet 4070 having openings 4082 and 4083 and expanding across the container 4004. Barriers 4097 and 4098 are moveable relative to the openings 4080 and 4083 for blocking openings 4082 and 4083, respectively. An actuator 4078 is provided for moving movable barriers 4097 and 4098. As in the previous embodiment, the dispenser 4014 is disposed in an upper region 4085 of the container 4004, whereas a lower region of the container 4095 accommodates a plurality of pills. Normally, the barrier 4097 is disposed such that is does not block opening 4082 and barrier 4098 is disposed such does not block opening 4083. In this pill-receiving mode of operation, pills in the lower region 4095 are free to move to the upper region 4085, when the dispenser is angled accordingly, but prevented from leaving the container through opening 4080 which is blocked by barrier 4098. When the container 4004 is turned upside down, the pills slide towards the receptacle 4014. When at least a portion of the pills have accumulated in the receptacle 4014, with one pill trapped within the apex of the receptacle 4014, the container 4004 is returned to an upright position. The non-trapped pills return to the lower region 4095 with the exception of the trapped pill. The dispenser 4014 in this embodiment is described in the general embodiment disclosed above. When the actuator is activated to move barriers 4098 and 4097 to block openings 4083 and 4082, respectively, the pill is dislodged from receptacle 4014, and is directed towards opening 4080 where is dispensed from the container to a hand of a user. In this pill-dispensing mode of operation, only the single pill is able to escape the container, the other pills are retained in the lower region 4095, trapped by moveable barriers 4097 and 4098 and sheet 4070. Optionally, other sheets, for example 4074, are provided for directing the pills away from potential traps. Advantageously, this embodiment provides a one-at-a-time pill dispenser that is inherently childproof.

In fact, any of the pills dispensers shown in FIGS. 4, 6, 24, 25, 27, 28, and 29, are inherently near childproof, since a child is not likely to understood the series of motions need to acquire a pill. In fact, even if a child is able to overcome the childproof mechanism, s/he is only able to acquire one pill at a time, thus providing additional time for a guardian to intervene. The embodiments shown in these Figures also illustrate one-at-a-time pill dispensers that virtually eliminate the possibility of spilling the contents of the containers to the ground. This is particularly advantageous for users who have difficulty in manipulating small objects which have been spilt, who cannot risk contaminating medication contained within the container, and/or those who have small children and cannot risk the posibility of having accidentally spilt medication remaining undetected on the ground. Furthermore, the embodiments shown in these Figures are desirable for user requiring medications that demand limited exposure to air and/or moisture.

Many variations on the invention will be obvious to those knowledgable in the field, and such obvious variations are within the scope of the invention as described and claimed whether or not expressly described. For example, any combination of the aforementioned embodiments is within the scope of the present invention.

What is claimed is:

1. A one-at-a-time pill dispenser, comprising:

a receptacle having an open end for receiving pills therethrough, an other end for preventing pills from passing therethrough, and a cavity defined by at least an internal surface of the receptacle extending from the open end and converging towards at least one apex proximate the other end along a path of convergence, the path of convergence selected for receiving at least a pill in a first static normally open receiving mode of operation wherein the internal surface converges toward the at least one apex, frictionally engaging a single pill from the at least a pill within the cavity in the first static normally open receiving mode of operation wherein the internal surface converges toward the at least one apex and for retaining the single pill therein in the first static normally open receiving mode of operation wherein the internal surface converges toward the at least one apex, the path of convergence also selected for allowing the release of the single pill through the open end in response to an external stimulus applied to the dispenser in a dispensing mode of operation, and the path of convergence also selected such that the cavity is capable of frictionally engaging and retaining therein one-at-a-time a plurality of pills having different maximum widths.

2. A pill dispenser as defined in claim 1, wherein the path of convergence is selected for engaging pills of different shapes.

3. A pill dispenser as defined in claim 2, wherein the size of the cavity is selected for accommodating a plurality of pills having a size equal the size of a smallest pill frictionally engagable and retainable within the cavity.

4. A pill dispenser as defined in claim 3, wherein the receptacle is disposed within a cover mountable to a container for holding a supply of pills.

5. A pill dispenser as defined in claim 4, wherein the receptacle is integrally moulded with the cover.

6. A pill dispenser as defined in claim 5, wherein the cavity is formed from a series of longitudinal projections extending from an interior surface of the cover.

7. A pill dispenser as defined in claim 6, wherein spacing between the longitudinal projections is selected to be small enough to exclude pills from engaging therebetween, and large enough to provide appropriate gripping action on the retained pill.

8. A pill dispenser as defined in claim 4, wherein the receptacle is disposed within a spherical member, said spherical member rotatably mounted to the cover in a hole of the cover, and rotatable for selectively exposing or concealing the open end of the receptacle disposed therein.

9. A pill dispenser as defined in claim 4, comprising a flexible flange coupled to a neck of the container, the flexible flange having a plurality of teeth for retaining the pills therein in a pill blocking position and for allowing communication between the dispenser and the container in a pill receiving position.

10. A pill dispenser as defined in claim 3, comprising a container having a first region therein for housing the receptacle and a second other region therein for accommodating a plurality of pills and comprising a restraining system for controlling communication between the first region, the second other region, and a third other region external to the container, the restraining system having a moveable barrier for allowing communication between the first and second other regions in the receiving mode of operation, and for preventing communication between the first and second other regions in the dispensing mode of operation.

11. A pill dispenser as defined in 10, comprising a second moveable barrier for preventing communication between the first and third other regions in the receiving mode of operation, and for allowing communication between the first and third other regions in the dispensing mode of operation.

12. A pill dispenser as defined in claim 11, wherein the first and second moveable barriers are different parts of a same object.

13. A pill dispenser as defined in claim 12, wherein the object has a cavity for accommodating the single pill in the dispensing mode of operation.

14. A one-at-a-time pill dispenser, comprising:

a receptacle having an open end for receiving pills therethrough, an other end for preventing pills from passing therethrough, and a cavity defined by at least an internal surface of the receptacle extending from the open end and converging towards at least one apex proximate the other end along a path of convergence, the path of convergence selected for receiving at least a pill in a first static normally open receiving mode of operation wherein the internal surface converges toward the at least one apex, frictionally engaging a single pill from the at least a pill within the cavity in the first static normally open receiving mode of operation wherein the internal surface converges toward the at least one apex and for retaining the single pill therein in the first static normally open receiving mode of operation wherein the internal surface converges toward the at least one apex, and means for affecting the friction between the internal surface and the single pill for releasing the single pill therefrom in a dispensing mode of operations, said cavity capable of frictionally engaging and retaining therein one-at-a-time plurality of other single pills having different maximum widths.

15. A one-at-a-time pill dispenser as defined in claim 14, wherein the path of convergence is selected to engage a single pill with sufficient force to require an external force to dislodge the pill, said path of convergence selected in dependence upon the surface material, the surface contour, and a coefficient of friction thereof.

16. A one-at-a-time pill dispenser as defined in claim 15, wherein the path of convergence is an approximately straight path.

17. A one-at-a-time pill dispenser as defined in claim 16, wherein the other end is an end fixed opposing the open end.

18. A pill dispenser as defined in claim 17, wherein the means for affecting the friction between the internal surface and the pill are deforming means for deforming the internal surface.

19. A pill dispenser as defined in claim 18, wherein the shape of the cavity proximate the at least one apex is approximately conical in the receiving mode of operation, and approximately rounded in the dispensing mode of operation.

20. A pill dispenser as defined in claim 19, wherein the receptacle is disposed within a cover for coupling to a container for holding a supply of pills.

21. A pill dispenser as defined in claim 20, wherein the cover includes a hole extending through a top portion of the cover, for accommodating a portion of the receptacle and wherein the portion of the receptacle protrudes from the hole in the cover, for providing bearing means for actuating the deforming means.

22. A pill dispenser as defined in claim 20, wherein the receptacle is dispoed within a spherical member, said spherical member rotatably mounted to a cover in a hole of the cover, and rotatably for selectively exposing or concealing the open end of the receptacle disposed therein.

23. A pill dispenser as defined in claim 20, comprising a flexible flange coupled to a neck of the container, the flexible flange having a plurality of teeth for retaining the pills therein in a pill blocking position and for allowing communication between the dispenser and the container in a pill receiving position.

24. A pill dispenser as defined in claim 20, wherein the container and cover form a substantially pen shaped assembly.

25. A pill dispenser as defined in claim 19, comprising a container having a first region therein for housing the receptacle and a second other region therein for accommodating a plurality of pills.

26. A pill dispenser as defined in claim 25, comprising a restraining system for controlling communication between the first region, the second other region, and a third other region external to the container, the restraining system having a moveable barrier for allowing communication between the first and second other regions in the receiving mode of operation, and for preventing communication between the first and second other regions in the dispensing mode of operation.

27. A pill dispenser as defined in claim 26, comprising a second moveable barrier for preventing communication between the first and third other regions in the receiving mode of operation, and for allowing communication between the first and third other regions in the dispensing mode of operation.

28. A pill dispenser as defined in claim 27, wherein the first and second moveable barriers are different parts of a same object.

29. A pill dispenser as defined in claim 19, wherein the dispenser is pivotably mounted to a cover having a hole, the dispenser pivotable to a position where the interior of the receptacle communicates with the interior of the container via the hole in the cover, for receiving pills from the container, and to another position where the interior of the receptacle communicates with the external environment via the opening, for dispensing the single retained pill, and where a portion of the dispenser blocks the hole in the cover, for preventing pills inside the container from being dispensed.

30. A pill dispenser as defined in claim 29, wherein the portion of the dispenser blocking the hole in the cover is a cam, positioned on an external side of said dispenser.

31. A pill dispenser as defined in the claim 30, including an actuator disposed on the dispenser opposite the open end of the receptacle for dispensing the retained pill.

32. A one-at-a-time pill dispenser for dispensing individual pills from a container containing a number of randomly arranged pills, said pill dispenser comprising:

a receptacle for forming an approximately static boundary for pill movement, said boundary defining a conical space in which a single pill having a predetermined size is free to move, said boundary also defining a region for frictionally engaging and trapping the single pill therein, and said boundary also defining a converging region for limiting the number of frictionally engaged and trapped pills to the single pill; and a cover for supporting the receptacle and for engaging a peripheral region of the container containing the randomly arranged pills.

33. A one-at-a-time pill dispenser as defined in claim 32, wherein the boundary is defined by a series of longitudinal projections within the cover.

34. A method of dispensing pills one-at-a-time using a one-at-a-time pill dispenser, said method comprising the steps of:

inverting the dispensers so that the pills fall into a receptacle of the dispenser, the receptacle for forming a boundary for pill movement, the boundary defining an approximately conical space in which a pill having a size within a predetermined range of pills sizes is free to move, the boundary also defining a region of frictionally engaging and trapping a single pill therein, and the boundary also defining a converging region for limiting the number of frictionally engaged and trapped pills to said single pill;

reverting the dispenser to an upright position so that all the pills except the single pill exit the receptacle;

exposing the single pill to an external environment; and, applying an external force to the dispenser so that the single pill is ejected therefrom into the external environment.

35. A method of dispensing pills one-at-a-time using a one-at-a-time dispenser as defined in claim 34 wherein during the step of inverting the dispenser a plurality of pills fall within the dispenser such that only one of the plurality is trapped therein.

* * * * *

UNITED STATES PATENT AND TRADEMARK OFFICE

CERTIFICATE OF CORRECTION

PATENT NO. : 6,267,265 B1
DATED : July 31, 2001
INVENTOR(S) : Issa

It is certified that error appears in the above-identified patent and that said Letters Patent is hereby corrected as shown below:

Title page,
Item [57], ABSTRACT,
Line 1, please insert -- or the like -- after the term "pill".

Column 1,
Line 36, "Synder teaches" should read -- Smalley teaches --.

Column 2,
Line 9, please insert the term -- In -- prior the term "U.S.",
Line 38, "device" should read -- devise --.

Column 4,
Lines 55 and 56, "cap" should read -- cup --.

Column 7,
Line 4, "dispense" should read -- dispenser --.

Column 8,
Line 20, "loner" should read -- longer --,
Line 33, "additionally" should read -- additional --.

Column 9,
Line 55, "preferably" should read -- particularly --,
Line 63, "comprise" should read -- comprises --.

Column 10,
Line 15, "sufficent" should read -- sufficient --,
Line 50, "taperd" should read -- tapered --.

Column 11,
Line 25, "allow" should read -- allows --,
Line 46, "contained" should read -- container --.

Column 12,
Line 26, "difficult" should read -- difficulty --,
Lines 48, 51 and 54, "moveable" should read -- movable --.

Column 13,
Lines 11, 17, 56 and 59, "moveable" should read -- movable --.

UNITED STATES PATENT AND TRADEMARK OFFICE

CERTIFICATE OF CORRECTION

PATENT NO. : 6,267,265 B1
DATED : July 31, 2001
INVENTOR(S) : Issa

It is certified that error appears in the above-identified patent and that said Letters Patent is hereby corrected as shown below:

Column 14,
Line 20, “moveable” should read -- movable --.
Line 21, “moveable” should read -- movable --,
Line 28, “understood the series of motions need” should read -- understand the series of motions needed --,
Line 39, “posibility” should read -- possibility --.

Column 15,
Line 53, “moveable” should read -- movable --.
Line 58, “moveable” should read -- movable --.

Column 16,
Line 16, “operations” should read -- operation --,
Line 17, insert the article -- a -- prior to the term “plu-”,
Line 51, “rotatably” should read -- rotatable --.

Column 17,
Lines 3, 9 and 15, “moveable” should read -- movable --.
Line 22, “another” should read -- an other --.

Column 18,
Line 16, “dispersers” should read -- dispenser --.
Line 20, “pills” should read -- pill --.
Line 21, the phrase “region of fric-” should read -- region for fric- --.

Signed and Sealed this

Tenth Day of September, 2002

*Attest:*

*Attesting Officer*

JAMES E. ROGAN
*Director of the United States Patent and Trademark Office*